US009747751B2

(12) United States Patent
Masen et al.

(10) Patent No.: US 9,747,751 B2
(45) **Date of Patent: *Aug. 29, 2017**

(54) METHOD AND SYSTEM FOR GAMING

(75) Inventors: Andrew B. Masen, Grafton (AU); Jennifer You, Randwick (AU); Ross M. Gilbertson, Ultimo (AU)

(73) Assignee: Bally Technologies ANZ PTY LTD, Milperra (AU)

( * ) Notice: Subject to any disclaimer, the term of this patent is extended or adjusted under 35 U.S.C. 154(b) by 43 days.

This patent is subject to a terminal disclaimer.

(21) Appl. No.: 13/042,647

(22) Filed: Mar. 8, 2011

(65) Prior Publication Data

US 2012/0034965 A1 Feb. 9, 2012

(30) Foreign Application Priority Data

Aug. 7, 2010 (AU) ..... 2010903536
Aug. 8, 2010 (AU) ..... 2010903538

(51) Int. Cl.
*A63F 9/24* (2006.01)
*G07F 17/32* (2006.01)

(52) U.S. Cl.
CPC ..... *G07F 17/326* (2013.01); *G07F 17/32* (2013.01)

(58) Field of Classification Search
CPC ..... G07F 17/32
(Continued)

(56) References Cited

U.S. PATENT DOCUMENTS 4,624,459 A 11/1986 Kaufman
4,721,307 A 1/1988 Okada
(Continued)

FOREIGN PATENT DOCUMENTS

AU 738363 9/2001
AU 771847 4/2004
(Continued)

OTHER PUBLICATIONS

Australian Examiner's First Report and Search Information Statement for AU Application No. 2011201004, dated Feb. 7, 2012, 5 pages.

(Continued)

*Primary Examiner* — Omkar Deodhar
*Assistant Examiner* — Ross Williams
(74) *Attorney, Agent, or Firm* — TraskBritt

(57) ABSTRACT

A gaming machine comprises a display and a game control to control images of symbols to be displayed on the display. Symbols are stored for positioning in an array. The symbols are divided into game-specific standard symbols and bonus symbols and are organized to define a bonusing scheme for filling fixed positions of the array. The game control randomly selects portions of the array for displaying images of the symbols in a matrix format on the display during a play of the game, and associates symbols within paylines of the matrix to provide play outcomes in accordance with the bonusing scheme and a paytable prescribed for the particular game. Different play options have a prescribed set of symbols associated with them. Each set is designed with a predetermined bonusing scheme, where the bonusing schemes are different between at least some of the play options and their associated set of symbols.

19 Claims, 23 Drawing Sheets

(58) Field of Classification Search
USPC ..... 463/16–20, 31–33
See application file for complete search history.

(56) References Cited

U.S. PATENT DOCUMENTS

| | | | | |
|---|---|---|---|---|
| 5,647,798 | A | 7/1997 | Falciglia | |
| 5,697,843 | A | 12/1997 | Manship et al. | |
| 6,004,207 | A | 12/1999 | Wilson, Jr. et al. | |
| 6,033,307 | A | 3/2000 | Vancura et al. | |
| 6,089,977 | A | 7/2000 | Bennett | |
| 6,093,102 | A | 7/2000 | Bennett | |
| 6,155,925 | A | 12/2000 | Giobbi et al. | |
| 6,394,902 | B1 * | 5/2002 | Glavich et al. | 463/20 |
| 6,663,487 | B1 | 12/2003 | Ladner | |
| 6,731,313 | B1 | 5/2004 | Kaminkow | |
| 6,780,109 | B2 | 8/2004 | Kaminkow | |
| 7,329,179 | B2 | 2/2008 | Baerlocher | |
| 7,419,429 | B2 | 9/2008 | Taylor | |
| 7,699,699 | B2 | 4/2010 | Gilliland et al. | |
| 7,704,141 | B1 | 4/2010 | Marks et al. | |
| 7,753,773 | B2 | 7/2010 | Baerlocher | |
| 7,828,648 | B2 | 11/2010 | Jackson | |
| 8,147,317 | B2 | 4/2012 | Plowman | |
| 8,506,380 | B2 | 8/2013 | Hughes et al. | |
| 2002/0022509 | A1 | 2/2002 | Nicastro et al. | |
| 2004/0048657 | A1 | 3/2004 | Gauselmann | |
| 2004/0087361 | A1 | 5/2004 | Parker | |
| 2004/0242313 | A1 | 12/2004 | Munoz | |
| 2005/0043085 | A1 | 2/2005 | Baerlocher | |
| 2005/0096121 | A1 | 5/2005 | Gilliland et al. | |
| 2005/0130737 | A1 | 6/2005 | Englman | |
| 2005/0181851 | A1 | 8/2005 | Amaitis et al. | |
| 2005/0215311 | A1 | 9/2005 | Hornik et al. | |
| 2006/0160613 | A1 | 7/2006 | Hornik et al. | |
| 2007/0218975 | A1 | 9/2007 | Iddings et al. | |
| 2007/0225060 | A1 | 9/2007 | Yoshimura | |
| 2008/0081688 | A1 | 4/2008 | Plowman | |
| 2008/0102923 | A1 * | 5/2008 | Esses et al. | 463/20 |
| 2008/0132321 | A1 | 6/2008 | Pau | |
| 2008/0182650 | A1 * | 7/2008 | Randall et al. | 463/25 |
| 2009/0117990 | A1 | 5/2009 | Englman et al. | |
| 2009/0170591 | A1 | 7/2009 | Fong | |
| 2009/0197667 | A1 | 8/2009 | Kim | |
| 2009/0227348 | A1 | 9/2009 | Yoshizawa | |
| 2010/0124969 | A1 | 5/2010 | Hughes et al. | |

FOREIGN PATENT DOCUMENTS

| | | | |
|---|---|---|---|
| AU | 2007216694 | A1 | 4/2008 |
| AU | 2007249148 | A1 | 7/2008 |
| AU | 2011201004 | A1 | 2/2012 |
| GB | 2335066 | A | 9/1999 |
| GB | 2382911 | A | 6/2003 |
| WO | 0115055 | A1 | 3/2001 |
| WO | 2007130464 | A2 | 11/2007 |

OTHER PUBLICATIONS

Third-Party Submission Under 37 CFR 1.290, including a Concise Description of Relevance, submitted Aug. 19, 2013 in U.S. Appl. No. 13/620,217, 8 pages.
Third-Party Submission Under 37 CFR 1.290, including a Concise Description of Relevance, submitted May 7, 2014 in U.S. Appl. No. 13/620,217, 9 pages.
Cover Letter from Nick Mountford to The Commissioner of Patents, dated Aug. 6, 2014, regarding Australian Patent Application No. 2011201004 and Opposition, 1 page.
Statutory Declaration by Oliver Crispino regarding Opposition in AU 2011201004 and Exhibit OC-1, dated Aug. 1, 2014, 6 pages.
Statutory Declaration by Benjamin James Ellis regarding Opposition in AU 2011201004 and Exhibits BJE-1 to BJE-8, dated Aug. 6, 2014, 313 pages.
Claim Amendments in Australian Patent Application No. 2011201004 and Opposition, Nov. 2014, 33 pages.
Australian Examiner's First Report for AU Application No. 2011101675, dated Feb. 7, 2012, 2 pages.
Australian Examiner's First Report Response for AU Application No. 2011101675, dated Jul. 27, 2012, 2 pages.
Australian Re-Exam Report for AU Application No. 2011101675, dated May 27, 2014, 6 pages.
Australian Re-Exam Report Response for AU Application No. 2011101675, dated Jul. 28, 2014, 6 pages.
Australian Re-Exam Report for AU Application No. 2011101675, dated Sep. 30, 2014, 4 pages.
Australian Re-Exam Report Response for AU Application No. 2011101675, dated Nov. 28, 2014, 8 pages.
Australian Re-Exam Report for AU Application No. 2011101675, dated Jan. 15, 2015, 2 pages.
Statutory Declaration by Benjamin James Ellis regarding Opposition in AU 2011201004 and Exhibit BJE-9, dated Jan. 12, 2015, 21 pages.
Statutory Declaration by Keiran Daley regarding Opposition in AU 2011201004 and Exhibits KD1, KD2, KD4, and KD6-12, dated Nov. 7, 2014, 115 pages.
Patent Oppositions—Decision Issued for AU Application No. 2011101675, dated Oct. 26, 2015, 16 pages.
Patent Oppositions—Decision Issued for AU Application No. 2011201004, dated Dec. 24, 2015, 22 pages.

* cited by examiner

FIGURE 5A
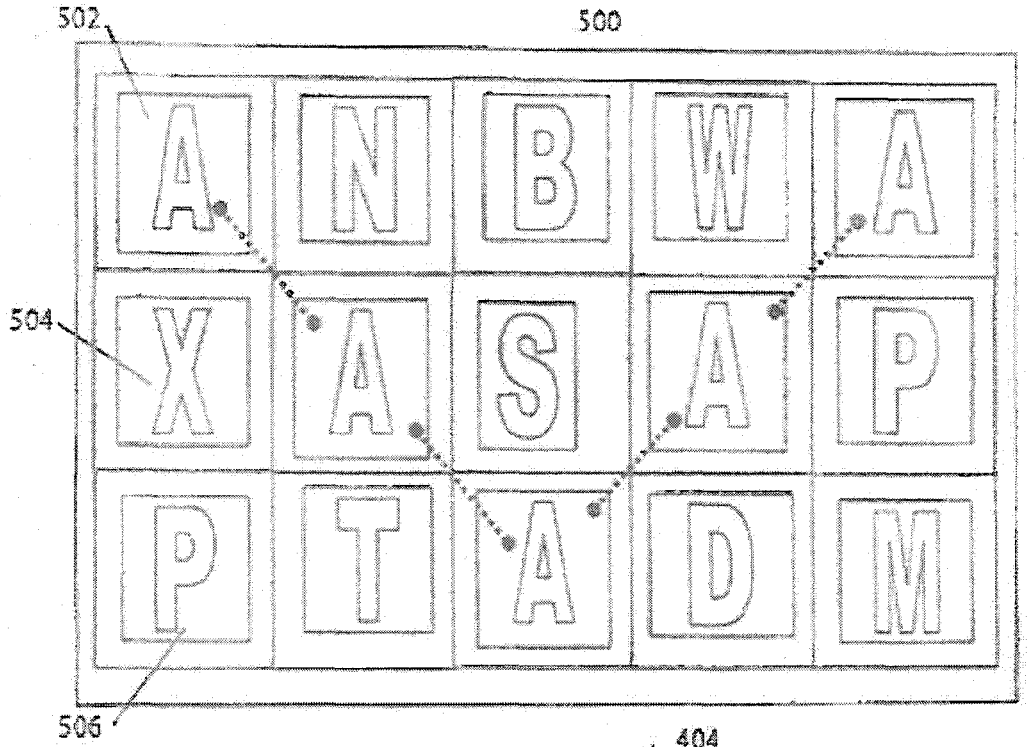
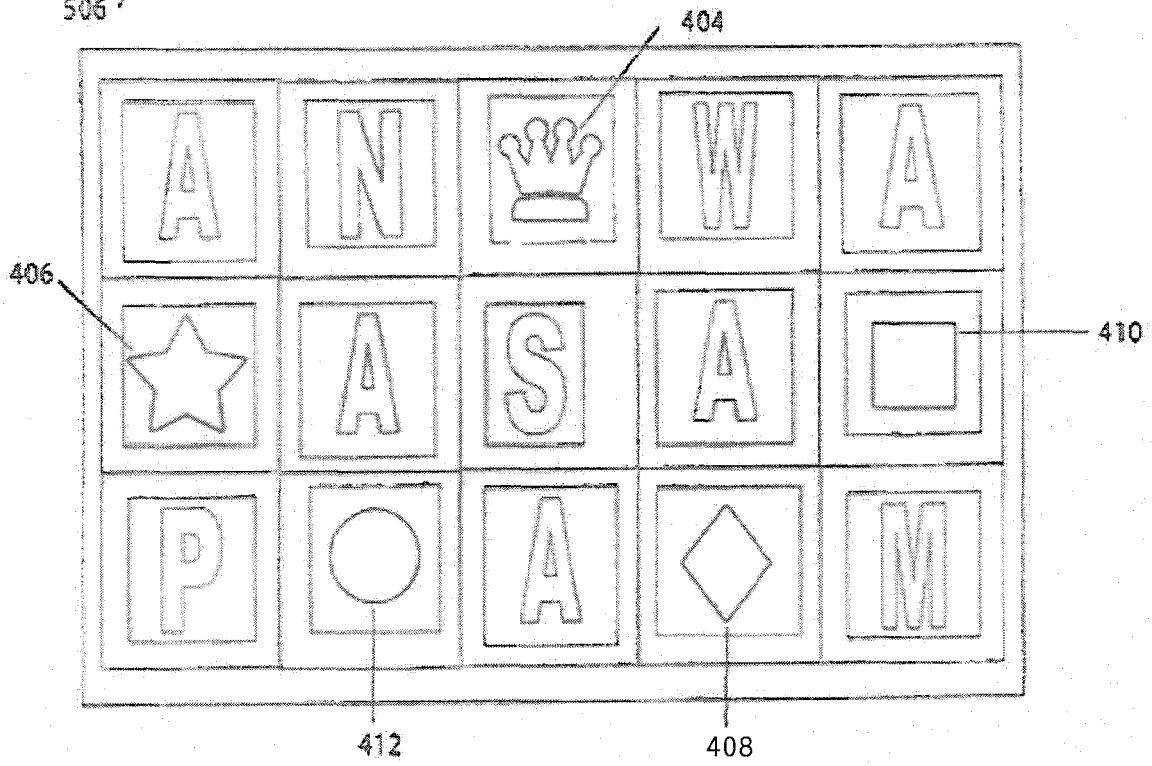
FIGURE 5B

FIGURE 7

| | | *Prize* |
|---|---|---|
| [A] | 5 of a kind | 80 credits |
| | 4 of a kind | 20 credits |
| | 3 of a kind | 5 credits |
| [K] | 5 of a kind | 80 credits |
| | 4 of a kind | 20 credits |
| | 3 of a kind | 5 credits |
| [Q] | 5 of a kind | 80 credits |
| | 4 of a kind | 20 credits |
| | 3 of a kind | 5 credits |
| [J] | 5 of a kind | 80 credits |
| | 4 of a kind | 20 credits |
| | 3 of a kind | 5 credits |
| [10] | 5 of a kind | 80 credits |
| | 4 of a kind | 20 credits |
| | 3 of a kind | 5 credits |

TABLE 7.1

| 1st PLAY | | | | |
|---|---|---|---|---|
| 1st PLAY OPTION [10] [1 credit] | 2nd PLAY OPTION [10]+[J] [5 credits] | 3rd PLAY OPTION [10]+[J]+[Q] [15 credit] | 4th PLAY OPTION [10]+[J]+[Q] +[K] [30 credit] | 5th PLAY OPTION [10]+[J]+[Q] +[K]+[A] [60 credits] |

TABLE 7.2

| | | *Prize* | *Increased prize* |
|---|---|---|---|
| [A] | 5 of a kind | 80 credits | 10000 credits |
| | 4 of a kind | 20 credits | 1000 credits |
| | 3 of a kind | 5 credits | 200 credits |
| [K] | 5 of a kind | 80 credits | 1500 credits |
| | 4 of a kind | 20 credits | 300 credits |
| | 3 of a kind | 5 credits | 20 credits |
| [Q] | 5 of a kind | 80 credits | 500 credits |
| | 4 of a kind | 20 credits | 100 credits |
| | 3 of a kind | 5 credits | 5 credits |
| [J] | 5 of a kind | 80 credits | 200 credits |
| | 4 of a kind | 20 credits | 50 credits |
| | 3 of a kind | 5 credits | 10 credits |
| [10] | 5 of a kind | 80 credits | 100 credits |
| | 4 of a kind | 20 credits | 40 credits |
| | 3 of a kind | 5 credits | 10 credits |

TABLE 7.3

GAME RULES

SELECT THE NUMBER OF CREDITS TO BET PER PLAY AND THEN
CHOOSE THE NUMBER OF GOLD SYMBOLS YOU WISH TO PLAY TO START GAME.
ALL WINS LEFT TO RIGHT ONLY EXCEPT SCATTERS WHICH PAY ANY.
ALL WINS ON LINES ONLY EXCEPT SCATTERS.
ALL 25 LINES ARE ACTIVATED DURING GAME.
SCATTER WINS ARE ADDED TO LINE WINS.
HIGHEST WIN ONLY ON EACH LINES.
WINS ON DIFFERENT LINES ARE ADDED.
ALL WINS EXCEPT SCATTERS MULTIPLIED BY THE TOTAL CREDITS BET PER PLAY.
SCATTER WINS ARE MULTIPLIED BY THE TOTAL CREDITS BET.
ALL WINS SHOWN IN CREDITS.
GAMBLE OPTION (WHERE AVAILABLE) MAY BE EXERCISED BY THE PLAYER AFTER ALL WINS.
GAMBLE AMOUNT IS DOUBLE (2X) IF RED/BLACK SELECTION IS CORRECT.
GAMBLE AMOUNT IS QUADRUPLED (4X) IF SUIT SELECTION IS CORRECT.
MAXIMUM OF 5 GAMBLE ATTEMPTS.THE REST OF THE GAMBLE OPTION WILL NOT EXCEED $10,000.
MAXIMUM WIN PER GAME IS $10,000.
MALFUNCTION VOIDS ALL PAYS AND PLAYS.

FIGURE 8

FREE GAMES

FREE GAMES ARE TRIGGERED BY 3 OR MORE SCATTERED .

FREE GAMES AWARDED DEPENDS ON THE NUMBER OF GOLD SYMBOLS PLAYED (AS DISPLAYED BELOW), EXCEPT 5 SCATTERED WHICH ALWAYS AWARDS 12 FREE GAMES.

| GOLD SYMBOLS PLAYED | PAY 1 | PAY 2 | PAY 3 | PAY 4 | PAY 5 |
|---|---|---|---|---|---|
| NUMBER OF FREE GAMES | 3 | 5 | 8 | 10 | 12 |

DURING THE FREE GAMES, IF ONE OR MORE OR SUBSTITUTES IN A WIN THE PAY FOR THAT WIN IS DOUBLED.

A, K, Q, J, 10 AND 9 DO NOT APPEAR DURING THE FREE GAMES.

THE CREDITS PER PLAY AND THE NUMBER OF GOLD SYMBOLS CHOSEN ARE THE SAME AS THE GAME THAT TRIGGERED THE FREE GAMES.

FREE GAMES CAN BE TRIGGERED AGAIN DURING THE FREE GAMES.

FIGURE 12

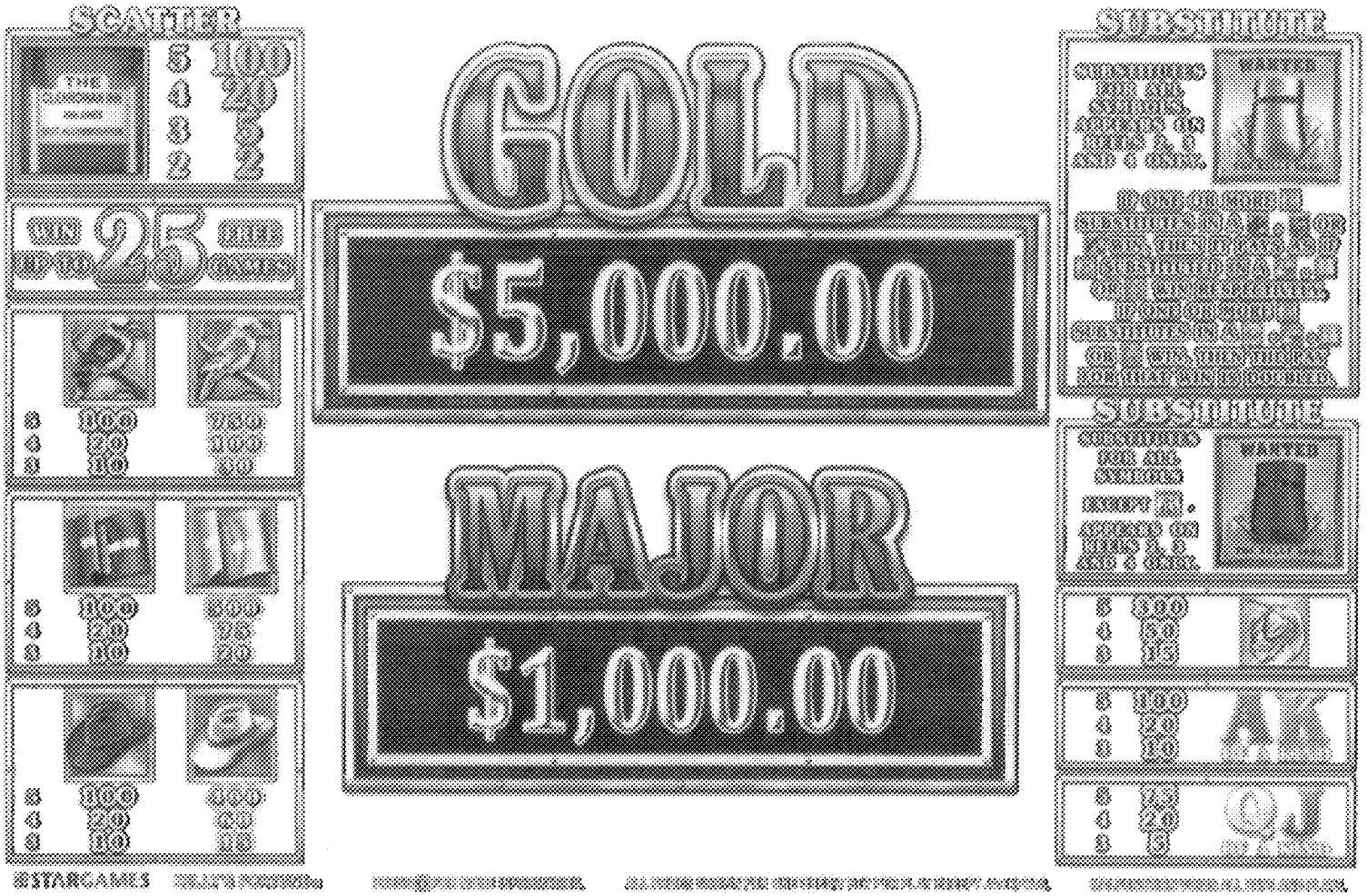
SUBSTITUTIONS
SUBSTITUTIONS
SCANNER
$55,000.00
$1,000.00
6250
1
2
3
4
5
6
7
8
9
10
11
12
13
14
15
16
17
18
19
20
21
22
23
24
25
26
27
28
29
30
31
32
33
34
35
36
37
38
39
40

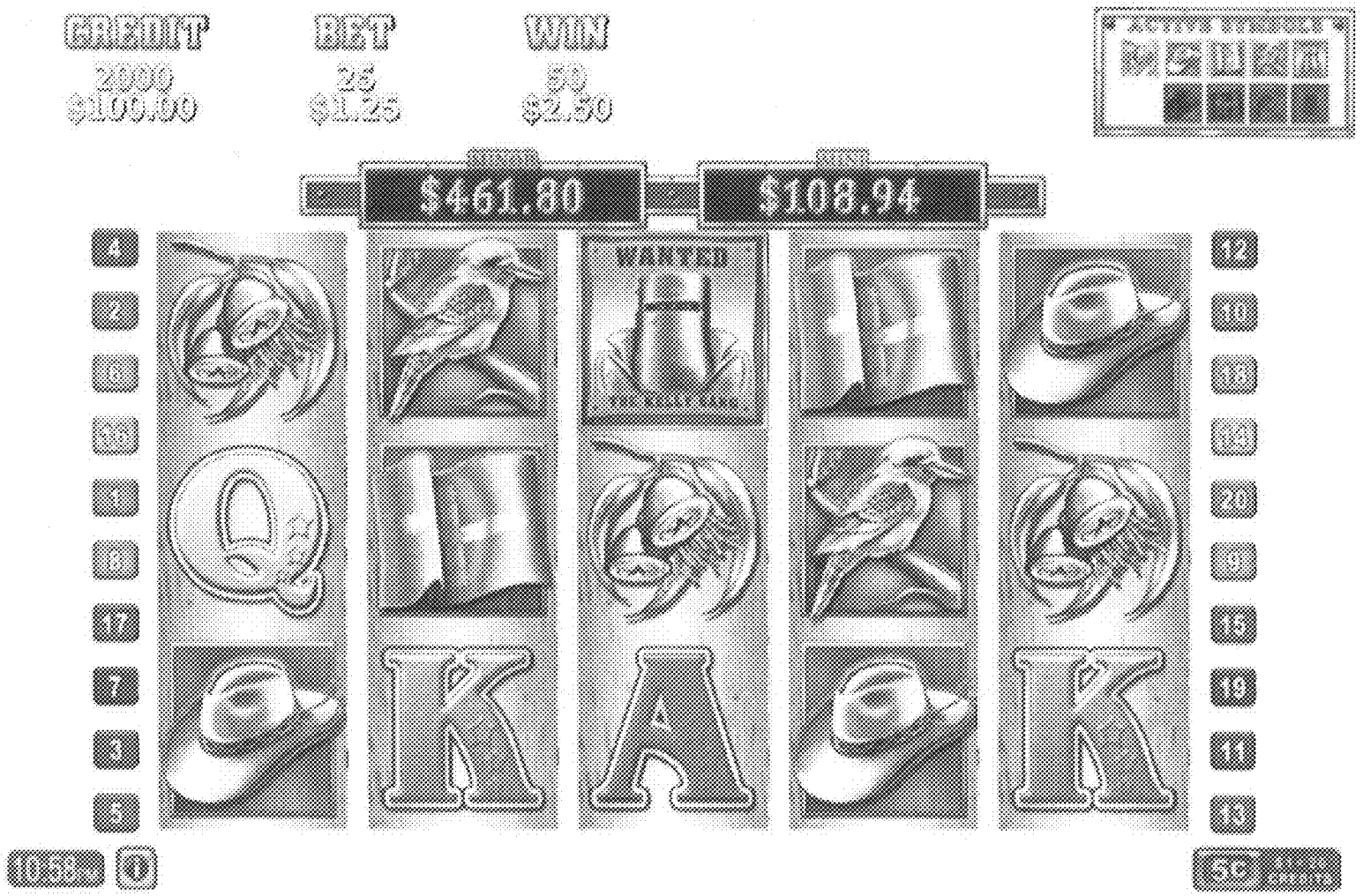
CREDIT
2000
$100.00
BET
25
$1.25
WON
50
$2.50
$491.80
$108.94
WILD
WILD
WILD

HAMMER AND ANVIL FEATURE

IN EACH STANDARD GAME MAY BE ADDED TO ANY 4 4 4 4 4 4 AND ON REEL 1,

IN EACH STANDARD GAME MAY BE ADDED TO ANY 4 4 4 4 4 4 4 4 AND ON REEL 2,

WHEN A APPEARS ON 4 4 4 OR IT IS ACTIVE,

WHEN A APPEARS ON 4 4 4 4 OR IT IS ACTIVE,

WHEN AN ACTIVE AND AN ACTIVE APPEAR ON A LIT LINE THE HAMMER AND ANVIL FEATURE IS TRIGGERED,

4 GOLD COINS WILL APPEAR AND FOR EVERY CREDIT BET PER PLAY A GOLD COIN WILL REVEAL A PRIZE,

THE SYMBOL ON EACH GOLD COIN IS A SYMBOL THE OR APPEARED ON,

COINS REVEAL 25, 50 CREDIT PRIZES OR , COINS REVEAL 25, 50, 100 CREDIT PRIZES OR ,

COINS REVEAL 50, 100, 200 CREDIT PRIZES OR , COINS REVEAL 100, 200, 300 CREDIT PRIZES OR ,

COINS REVEAL 200, 300 500 CREDIT PRIZES OR ,

WHEN A IS REVEALED A GOLD, MAJOR, MINOR OR MINI JACKPOT IS AWARDED,

IF AN ACTIVE AND AN ACTIVE OCCUR ON MORE THAN ONE LIT LINE THEN FOR EVERY LINE TRIGGERED, A SEPARATE SET OF 4 GOLD COINS WILL BE PRESENTED, THE HAMMER AND ANVIL FEATURE CANNOT BE TRIGGERED DURING THE FREE GAMES.

FIGURE 19

METHOD AND SYSTEM FOR GAMING

CROSS-REFERENCE TO RELATED APPLICATIONS

This application claims priority to Australian Provisional Patent Application No. 2010903538 filed Aug. 8, 2010. This application also claims priority to Australian Provisional Patent Application No. 2010903536 filed Aug. 7, 2010.

TECHNICAL FIELD

This invention relates to wagering games and bonusing systems for electronic gaming machines.

The present invention is applicable, although not exclusively, to electronic gaming machines that have one or more bonus symbols included with other symbols in an array of symbols that are to be displayed on a video screen and, where prescribed, sets of these symbols are randomly selected from the array and displayed in a matrix as a result of a play.

Throughout the specification, unless the context requires otherwise, the word "comprise" or variations, such as "comprises" or "comprising," will be understood to imply the inclusion of a stated integer or group of integers but not the exclusion of any other integer or group of integers.

The term "pseudo-random" is used herein to mean that a selection is made on a random basis from within a limited range.

BACKGROUND

The following discussion of the background art is intended to facilitate an understanding of the present invention only. It should be appreciated that the discussion is not an acknowledgement or admission that any of the material referred to was part of the common general knowledge as of the priority date of the application.

Players who regularly play gaming machines tire of particular games as the entertainment factor or winning opportunities reduce or become staid. Therefore, it has become necessary for manufacturers of these machines to develop innovative games that differ from previous types of games and have variety and bonuses in the form of features or jackpot awards that add interest to the games. In so doing, it is hoped to keep players entertained and, therefore, interested in continuing to play the game, as well as attract new players to the game.

With the growth that has occurred in the gaming machine market, there is intense competition between manufacturers to supply gaming machines to venues that provide for the playing of these machines. When selecting a supplier of gaming machines, the operator of a venue will usually pay close attention to the popularity of various games played by their patrons. Therefore, gaming machine manufacturers are continually devising new games and/or bonuses that are popular with players in order to improve sales, retain customers and attract new customers.

One form of gaming machine that has proven to be particularly popular over the years has been the spinning reel machine. These types of machines have now evolved into displaying a number of simulated, or "virtual," reels displayed on video display systems having various symbols displayed at prescribed locations on the reels. Each reel has a prescribed number of positions that correspond to positions in an array whereby the position and sequence in the array may be represented by a symbol bearing some distinctive value in a sequence of symbols in paylines or generally distributed on the display screen of the same or predefined type.

The individual reels are simulated to rotate during a play, and stop in a position that may be required to be positioned relative to a predefined pattern within the video display to show one or more rows of symbols, paylines or random distributions from adjacent reels or the totality of reels in a window or in a virtual display. In this manner, the reels are usually aligned to form a regular matrix of rows and columns of symbols that are displayed to the player for analysis of winning or losing events by the player or a processor associated with the electronic gaming machine (EGM).

A common window configuration is a matrix of 3 rows and 5 columns, but other combinations are also known. By virtue of adopting a regular matrix, it has become common to adopt one or more paylines that are defined across the matrix and can be displayed in the window. For example, the center row, the top row, the bottom row, and possibly one or more meander lines (e.g., non-linear distributions). A payline identifies the particular combination of positions at which symbols are located within the matrix, extending logically across the columns and through rows, that is considered for determining whether a bonus trigger symbol occurrence arises from a play or not. Random distributions of particular symbols ("scatter pays") may also be used to provide winning outcomes, bonus triggers and bonus wins. These scatter pay events do not necessarily require the symbols to be adjacent or in any predefined order, but merely appear in sufficient number on the display screen.

In order to increase betting opportunities available to the player, some games have been developed that adopt up to 40 or more paylines. In these and other arrangements, non-linear paylines and scatter pays are also known. Typically, most gaming machines provide for selection of up to 25 paylines.

The player may select (by wagering or purchasing) one or more paylines per game. The paylines are normally automatically selected by a processor in a fixed sequence. For example, if the player selects one payline, this will normally be the central horizontal line. Similarly, selecting two paylines will activate the center payline and the top horizontal payline. The player may also select the amount wagered per line. A payline is active if the player has wagered sufficient amounts of credits or value so that a sufficient amount activates paylines to include a particular payline or specifically selected individual paylines or groups of paylines. Paylines that are not active are inactive.

It is common knowledge that most gaming machines are designed so that the player has the highest probability of winning and/or triggering a bonus when the maximum number of paylines is selected. This, however, means that the player has to wager a comparatively large amount for each play, compared to the minimum amount that may be wagered for a play of the machine. Volatility is related to the size of the bonus awarded relative to the frequency of winning. Having bonuses awarded less often for comparatively large amounts is known as high volatility, whereas bonuses being awarded more often for comparatively small amounts is known as low volatility.

Typically, bonuses are triggered when a bonus trigger symbol occurrence (e.g., a specific symbol or multiple specific symbols) is generated by a processor and the specific symbol or multiple specific symbols are displayed in the window. Alternatively, a bonus trigger event may be entirely random and not associated with the symbols displayed in the window at all (e.g., a particular quantum of play is reached on the machine, or an accumulating jackpot threshold is reached, unbeknown to the player).

Symbols on a reel are generally divided up between standard symbols and bonus symbols. The relative mix and number of bonus symbols to standard symbols appearing on a reel and across reels, provide a prescribed bonusing scheme for the game. When this bonusing scheme is combined with the paytable adopted for a particular game, it also provides a particular volatile character or feel to the game, which is conveyed to the player.

Multiple line games, as well as for providing an easy means of delivering linearity (i.e., ensuring that the probability of winning is maintained proportional to the credits bet per play), also allow the player to choose the particular level of volatility they desire. This provides greater utility for the one game appealing to players who prefer different levels of volatility by choosing the number of paylines they wish to play with.

Games are precisely designed mathematically to provide a prescribed bonusing scheme in combination with a paytable that achieves a return to player requirement that complies with gaming regulations mandated for a particular jurisdiction. Consequently, it is a constant challenge for gaming machine manufacturers to come up with new games that appeal to players that may satisfy their variable need for volatility and provide an entertainment experience.

Accordingly, gaming machine manufacturers are continually designing new and innovative combinations of games and bonusing schemes that have more appeal to players than others in order to add to the sales appeal of a particular gaming machine.

DISCLOSURE

According to one aspect, the present invention provides a method for operating an electronic gaming machine, including at least the steps of providing a player interface, said interface requiring a player to select from a plurality of different game play options, wherein each game play option has an associated subset from a game symbol set, at least some of the subsets associated with game play options being different from each other; and playing a game in accordance with the selected game play option.

According to another aspect, the present invention provides an electronic gaming machine, including a display, a player interface, and a processor adapted to control the game play and the display, said player interface requiring a player to select from a plurality of different game play options, wherein each game play option has an associated subset from a game symbol set, at least some of the subsets associated with game play options being different from each other, said processor operatively playing a game in accordance with the selected game play option.

BRIEF DESCRIPTION OF THE DRAWINGS

The invention is described with reference to the following drawings of different specific embodiments of a mode for carrying out the invention, wherein:

FIGS. 5A and 5B illustrate the window display of an EGM showing a matrix format of symbols selected from an array for play, wherein FIG. 5A shows only standard symbols displayed, and FIG. 5B shows a combination of both standard and bonus symbols;

FIG. 7 is a series of tables illustrative of a game in accordance with a first embodiment of the mode for carrying out the invention;

FIG. 8 shows game rules for playing a game in accordance with a second embodiment of the mode;

FIG. 12 shows free games rules that are applied in the game of the second embodiment;

FIG. 13 shows a top box used for a game in accordance with a third embodiment of the mode;

FIGS. 18A to 18C show a window with the same arrangement of symbols displayed as a result of a play with different active symbols selected for the bonus symbols used in the game of the third embodiment, wherein:

FIG. 18A shows the window with only a base special symbol activated;

FIG. 18B shows the window with only the base and next level special symbol activated; and FIG. 18C shows the window with all of the special symbols activated;

FIG. 19 shows the rules applicable to a feature and jackpot award system associated with the game of the third embodiment.

DETAILED DESCRIPTION

A mode for carrying out the invention will be described with reference to an electronic gaming machine (EGM) being programmed and configured to implement one or more different wagering games. Several specific embodiments of games designed in accordance with the invention will be subsequently described as part of the mode.

Figure 1:
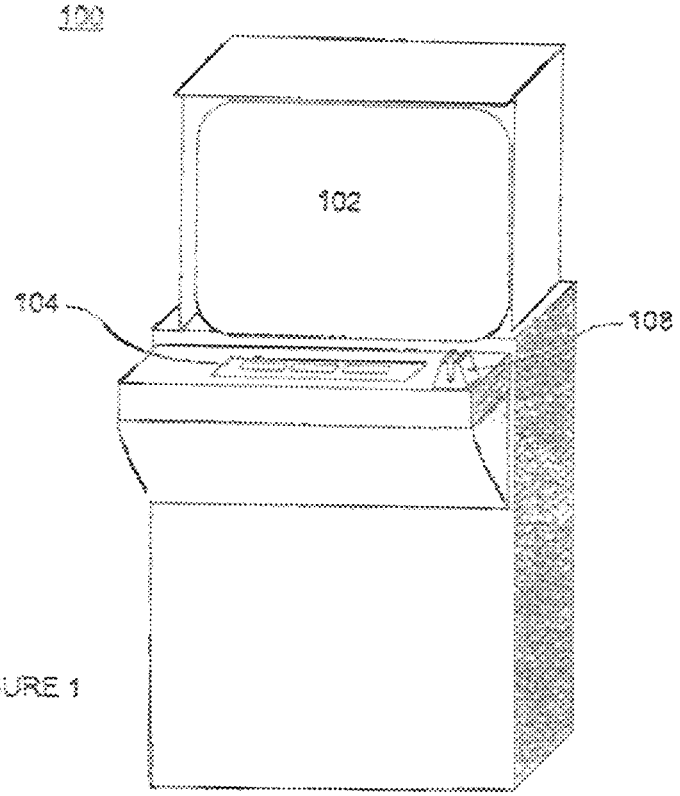
FIG. 1 is a diagram illustrative of an electronic gaming machine (EGM)

As shown in FIG. 1, an EGM 100 includes a display means in the foi n of a display screen 102, player input buttons 104, and credit (or currency) input 108. The EGM 100 is configured so that when a player has entered sufficient credits from the credit input 108, the player is permitted to select a game using the player input via buttons 104 or touch screen buttons (not shown) displayed on the screen 102, if the EGM 100 is designed to play one of multiple games that can be downloaded. Alternatively, the EGM 100 invokes a routine for playing a prescribed game automatically.

In the presently described mode, once a particular game is invoked, the EGM 100 is specifically configured so that the player can then select one of a number of different play options and credits per play that are provided as part of the game, using the player input buttons 104.

Figure 2:
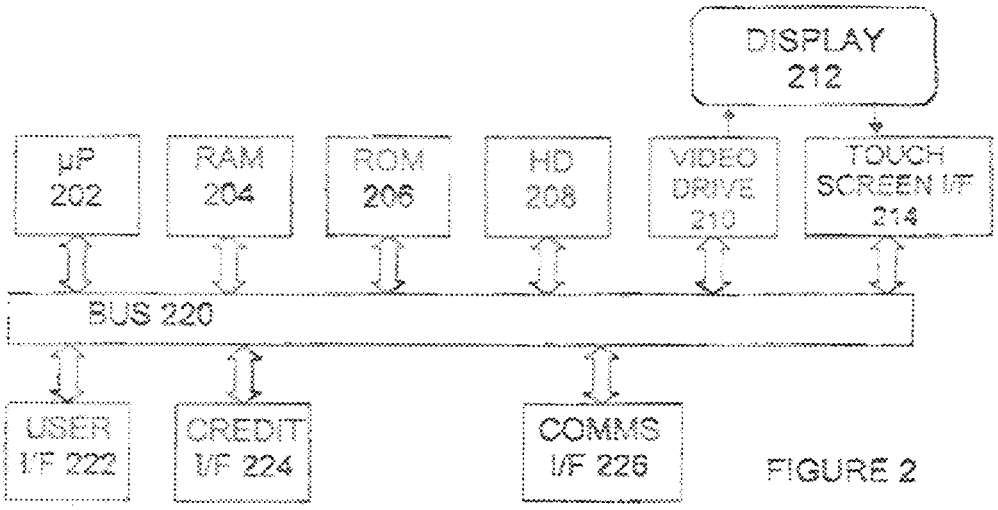
FIG. 2 is a functional block schematic diagram of functional elements of an EGM.

As shown in FIG. 2, the EGM includes a control means in the form of a processor 202 shown for illustrative purposes as connected via bus 220 to a plurality of functional elements. The EGM includes a display 212 with associated video driver 210 and touch screen interface 214, various storage devices such as RAM 204, ROM 206 and hard drive 208, a user interface 222, credit interface 224, and communication interface 226. The EGM can be a stand-alone machine, or it can be connected to a network via the communication interface 226, to enable the machine to participate in multi-game jackpots. In addition, the EGM is programmed via the communication interface 226 from a central control and management processor, so that, for example, new games can be programmed and downloaded into the EGM.

In the presently described mode, the EGM produces a reel display that comprises a different reel design or reel activity depending upon which particular play option is invoked by the selection of a player as previously described. In other modes, the EGM may impose a limitation on the activity of frames, spaces or symbols within a fixed array by means other than a reel. Each reel has a plurality of symbols L associated with it, the symbols being elements of an array that comprises all of the symbols associated with all of the reels. In this manner, each reel represents a subdivision of the array, so that the array is notionally divided into discrete sub-arrays, each sub-array comprising the symbols associated with a corresponding reel. The relative position of the symbols L on the reel during a play of a game is notionally or logically fixed, so the player sees a portion of each reel formatted in the form of a matrix. The matrix appears in a window displaying a number of rows in which a sequence of symbols virtually scrolls down the column in which the reel is displayed during a play. The symbols of the reel can thus be defined in terms of the particular reel and the corresponding sub-array of specific symbols associated with it, and the place of a symbol in the sequence of symbols comprising the sub-array.

As previously described, each play option has a predetermined design and mix of symbols associated with it, which are stored in the memory of the EGM for subsequent loading to fill the array with symbols corresponding to the particular reel design associated with the selected play option.

Figure 3:
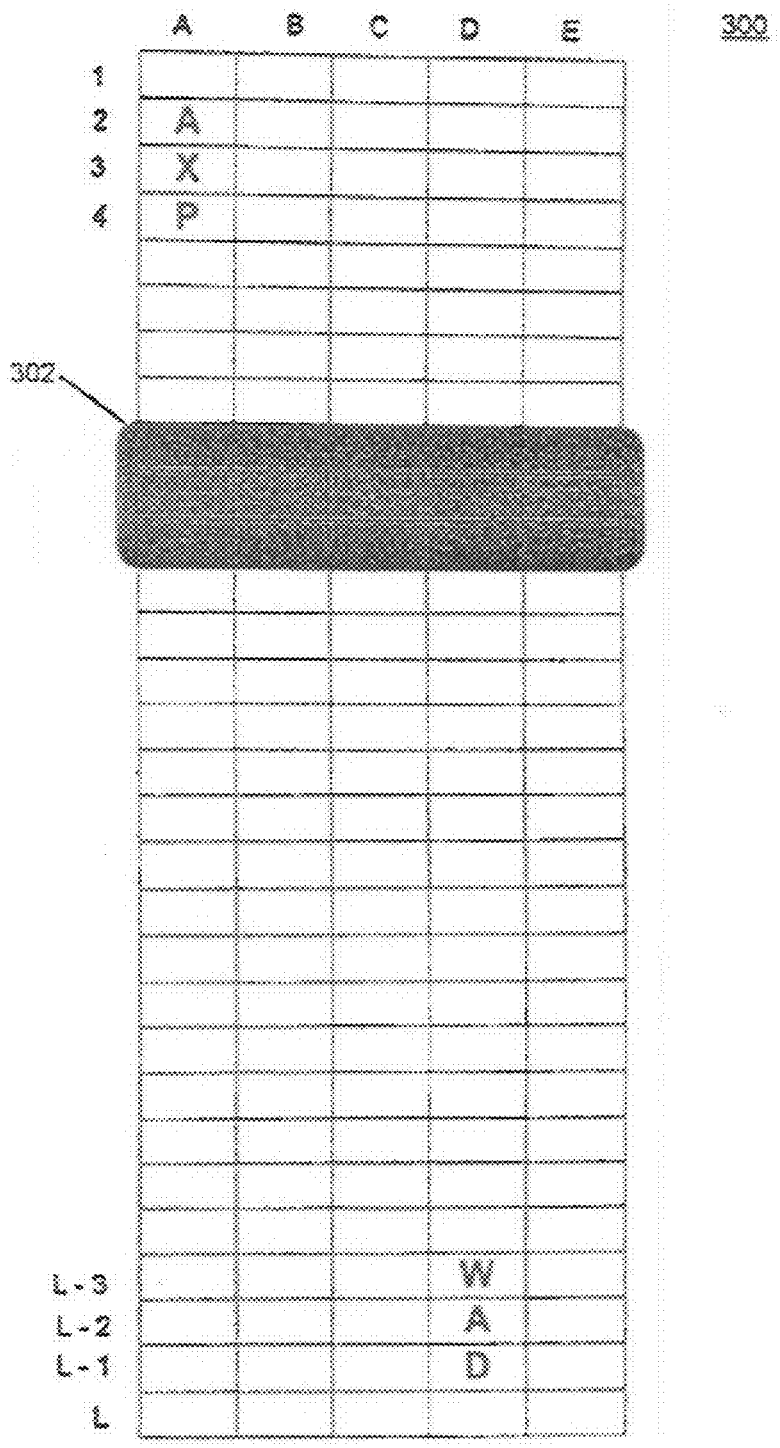
FIG. 3 represents a five-reel array.

As shown in FIG. 3, the matrix of symbols displayed, as provided by a five-reel array 300, has reels A, B, C, D, and E, each reel having L symbols. The symbols are displayed in a repeating sequence, so that 1 follows L (or, alternatively, L follows 1) in a loop until the reel stops. The symbols are divided into game-specific standard symbols and bonus symbols logically filling fixed positions in the array 300 in a prescribed manner.

A window 302 spanning 3 rows and the 5 columns is shown to indicate a pay window on the screen. Thus, a symbol can be represented by the column identifier (A, B, etc.) and the row number, where one symbol is notionally assigned as the start symbol 1. An image of a symbol is displayed by action of the processor and signals sent to the display means, and the images and/or combinations of images on a payline are allocated different values and provide different winning opportunities depending upon the occurrence in prescribed combinations as determined by a paytable prescribed for the wagering game played on the EGM. When the EGM is programmed, the program thus includes the parameters of each symbol, including the reel, the symbol position, and the image details (the symbol type).

The probability of a particular symbol being displayed on a reel or a virtual reel is determined by the number of that type of symbol in a reel divided by the number of symbols in the reel (L), in the absence of mathematical weighting of the symbols, as is known in the art. In one embodiment, no mathematical weighting is applied to the individual symbols other than their natural frequency of occurrence from within the total number of available symbols. Thus, where there is only one of a particular symbol in a reel, its probability of appearing in a specific position, such as the centerline of the window, is 1/L.

In playing a game, the program uses a pseudo-random number generator to determine which symbols will be displayed in the window 302 for each reel by selecting a number between 1 and L for each reel to appear, for example, on the centerline. Thus, a particular symbol and its neighboring symbols (each symbol typically being independently selected randomly or pseudo-randomly) will appear in the window 302 where three lines are displayed. It will be understood that in different embodiments of the invention, and indeed in different play options associated with the same game of each embodiment, the reels A, B, C, D and E may be of different lengths and that the lengths of each reel are independent of one another. That is, there is no requirement that the reel lengths be equal, multiples of each other, or have any other dependency on one another, between the different play options. Accordingly, the probability of a particular symbol appearing in a specific position in the window 302 is dependent on the number of that particular symbol contained on that particular reel and the length of that reel.

As shown in FIG. 3, three consecutive symbols A, X, and P are shown in reel A at positions 2, 3, and 4, and a further three consecutive symbols W, A, and D are shown in reel D at positions L-3, L-2, and L-1. FIG. 3 illustrates the position of the reels at the beginning of a selected play option for a particular game. For the sake of explanation, row 1 is shown at the top of the matrix. In practice, the symbol corresponding to row 1 will be in a position determined by the result of the previous game.

FIG. 5A shows the window 500 after a game spin of the selected play option. During the playing of the game, the symbol A3 (FIG. 3), which is shown as the letter X (504), is randomly chosen as the symbol to be displayed on the middle line of the window 500, so the symbol A2 (the letter A 502) and the symbol A4 (the letter P 506) are shown in the first column in the window 500 on either side of the X. Similarly, for reel D, the symbol A corresponding to the position L-2 in FIG. 3 has been randomly selected to be displayed on the center row of the window 500.

Also shown in FIG. 5A are five A symbols, one on each reel. The five A symbols are located on the fourth payline, which is illustrated by the dotted lines. In such a scenario, this will result in the awarding of a payout in accordance with the paytable of the gaming machine corresponding to this particular play outcome.

In the present mode, the symbols designed for inclusion in a particular reel design of a play option comprise both standard symbols and bonus symbols. Standard symbols have a relatively low value and, optionally, pay lower returns for specific combinations appearing on a payline than do bonus symbols.

Figure 4:
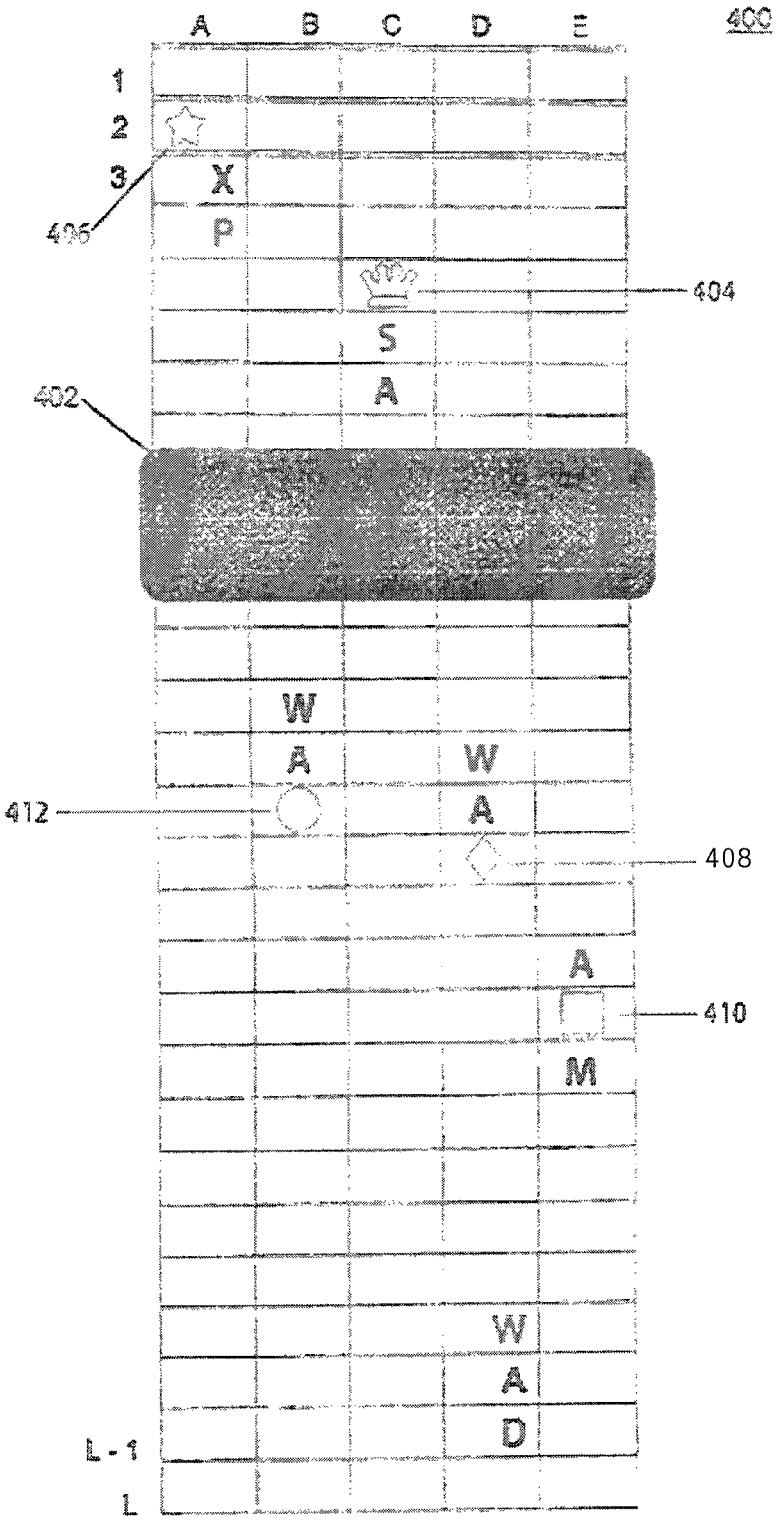
FIG. 4 shows a reel arrangement with the addition of a number of bonus trigger symbols.

FIG. 4 shows a reel arrangement 400 and window 402 similar to that of FIG. 3 with the addition of a number of bonus symbols 404, 406, 408, 410, 412 to standard symbols W, X, A, P, D, M, S, etc, as described with respect to FIGS. 3 and 5A. The particular mix and number of bonus symbols to standard symbols appearing in the reel positions of a particular play option is predetermined by the various game designs and when the individual game is selected, the particular mix of game-specific standard symbols and number of bonus symbols is provided for filling the array to be invoked by the game program in response to the selection of the particular play option by the player. The bonus symbols are shown as crowns 404, stars 406, diamonds 408, squares 410 and circles 412, but other symbols can be used, such as iconic characters or symbols in keeping with the theme of the game.

The bonus symbols are graded, ranked or given a hierarchy in terms of their bonus value. For example, a crown is valued higher than a star, which, in turn, is valued higher than a diamond, which, in turn, is valued higher than a square, which, in turn, is valued higher than a circle.

Depending upon the game, some bonus symbols can also be enhanced to be of higher value than in their base state. For example, the enhancement may be a color, such as gold. So, in their base state, the bonus symbols may be of a flat color, but in their enhanced state, they may be gold in color. In terms of game design, these enhanced symbols logically constitute additional bonus symbols but follow a theme in terms of their selection between an enhanced and unenhanced state, according to the particular play option selected. In this manner, the same theme can be maintained between different play options to provide the player with the experience that they are playing the same game, regardless of the particular game option selected, but, in reality, involves a different bonusing scheme (and thus player experience between the play options) that arises from effectively playing a different game in each play option.

To achieve this dynamic effect between the play options, certain symbols may be included in some reels but not in others, or in different numbers, or in different mixes of bonus and standard, depending upon the particular play option involved. For example, in one particular play option, the crown may not be included in reel A or E, or may be included in reduced number, but may be included in the other reels in greater numbers, whereas the other symbols may be included in all reels. In another play option, the crown may be included in relatively greater numbers in reels A or E, and fewer numbers in other reels. In specific embodiments of the game described later, the enhanced bonus symbols are selectively included in particular reels according to the particular play option that is selected, and not included in others, and are also graduated in bonus value. In this manner, the enhanced symbols provide increased returns as a proportion of the amount bet as a player moves through the different play options in order to balance against progressively decreasing returns of standard and unenhanced symbols in the event that the bonusing scheme is maintained relatively constant between the play options, as a consequence of adopting the same paytable.

By including such flexibility in the different design of reels between different play options, the game designer is provided with more variables to design a game within prescribed parameters of return-to-player (RTP), hit rate, and bonusing scheme for a common paytable, while seeking to achieve the elusive goal of the game being fun to play.

In the presently described mode, there are 5 play options available. In other modes, different numbers of play options may be used.

In this mode, there is a correspondence between the number of play options and the number of bonus symbols. Furthermore, there is a correspondence between the number of bonus symbols that are enhanced and the number of the play option. For example, if the first play option is chosen, then there is one enhanced bonus symbol that is activated. If the second play option is chosen, then there are two enhanced bonus symbols activated, and so on, until in the fifth play option, all five enhanced bonus symbols are activated.

In addition, in keeping with the theme of the games that embody the described mode for carrying out the invention, the grading in value of the bonus symbols corresponds with the particular play option chosen. For example, having regard to the set of symbols referred to above, the circle is the lowest graded bonus symbol, and will be enhanced for the first play option. The square is the next graded bonus symbol and will be enhanced in the second play option, and so on.

Furthermore, once a bonus symbol is enhanced in a particular play option, it is retained in an enhanced state for all higher play options. In this manner, the enhanced bonus symbols accumulate with increasing the number of the play option.

In this arrangement, logically, the lowest valued bonus symbol, e.g., the circle, will always be in an enhanced state.

The logic of the aforementioned rules of the game is implemented by way of a computer program that is effected by the processor 202. This is conveniently illustrated in the flow and state diagrams shown in FIGS. 6A and 6B and the process structure diagram in FIG. 6C.

Correlating the flow charts to the example above, reference to gold symbols corresponds to enhancement of a bonus symbol. The symbol types will be as follows: A=circle; B=square; C=diamond; D=star; and E=crown.

Figure 6A:
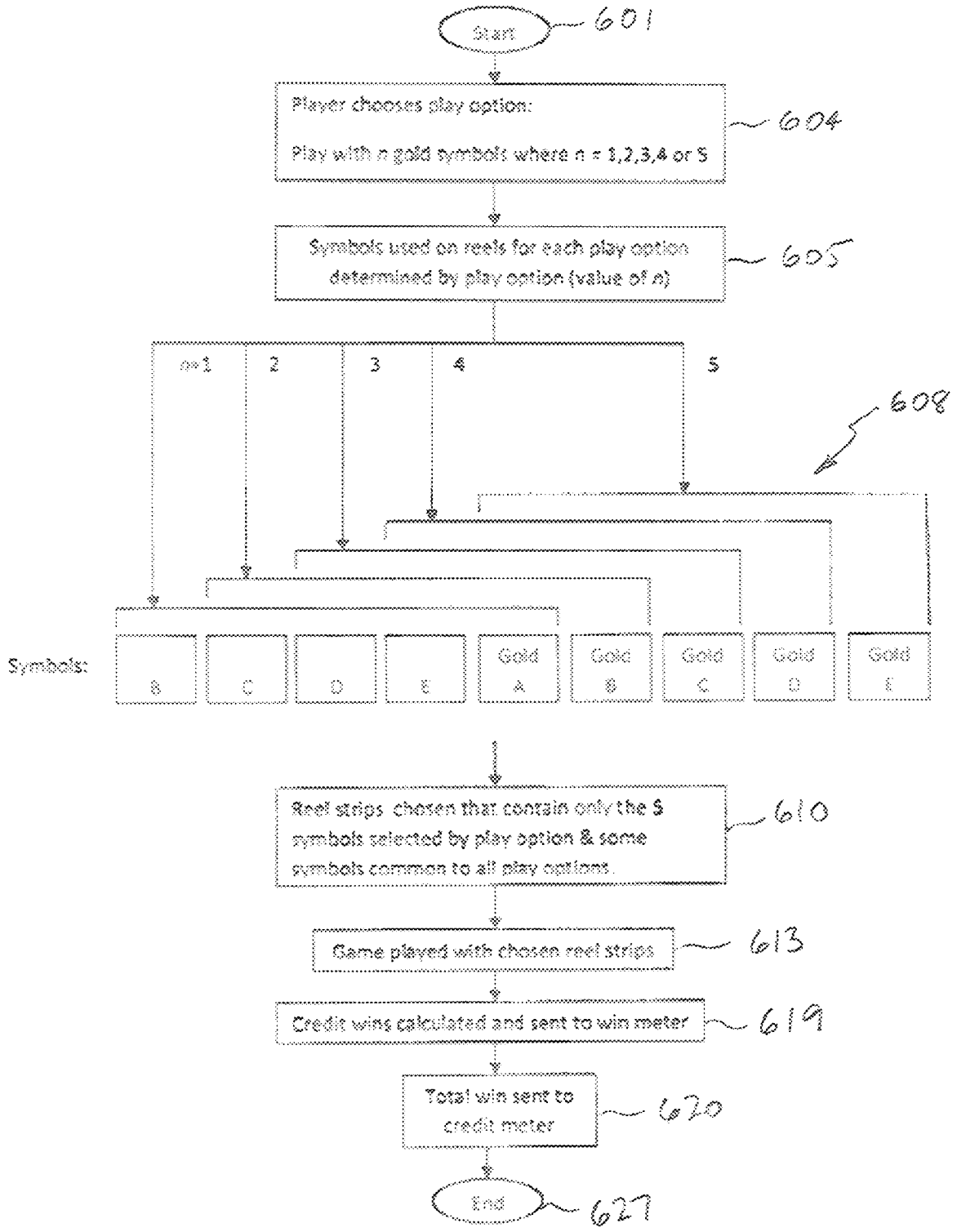
FIG. 6A is a flow diagram showing an overall program flow common to each of the specific embodiments of the mode for carrying out the invention.
Figure 6B:
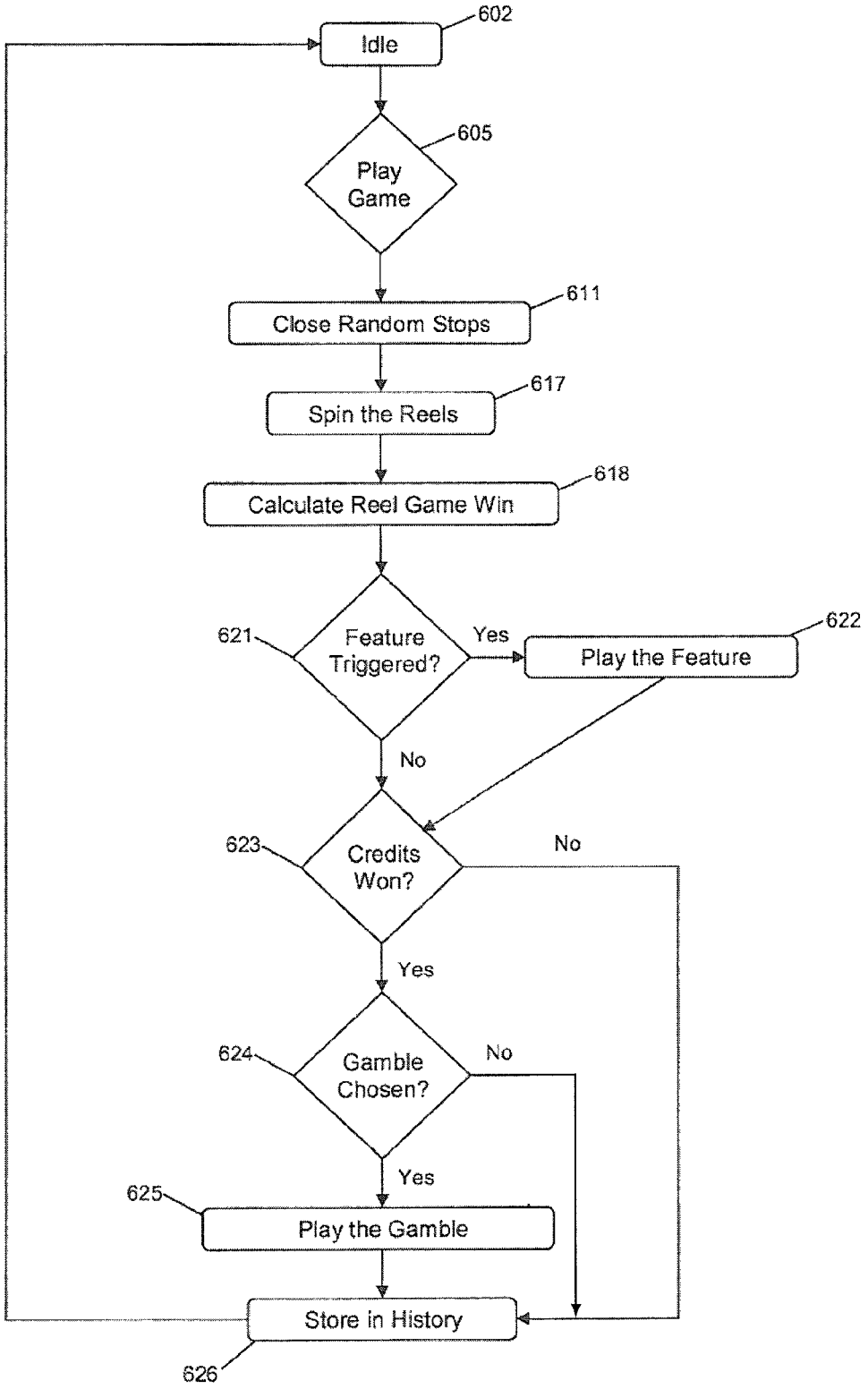
FIG. 6B is a flow diagram showing various states of software in synthesizing a program flow.
Figure 6C:
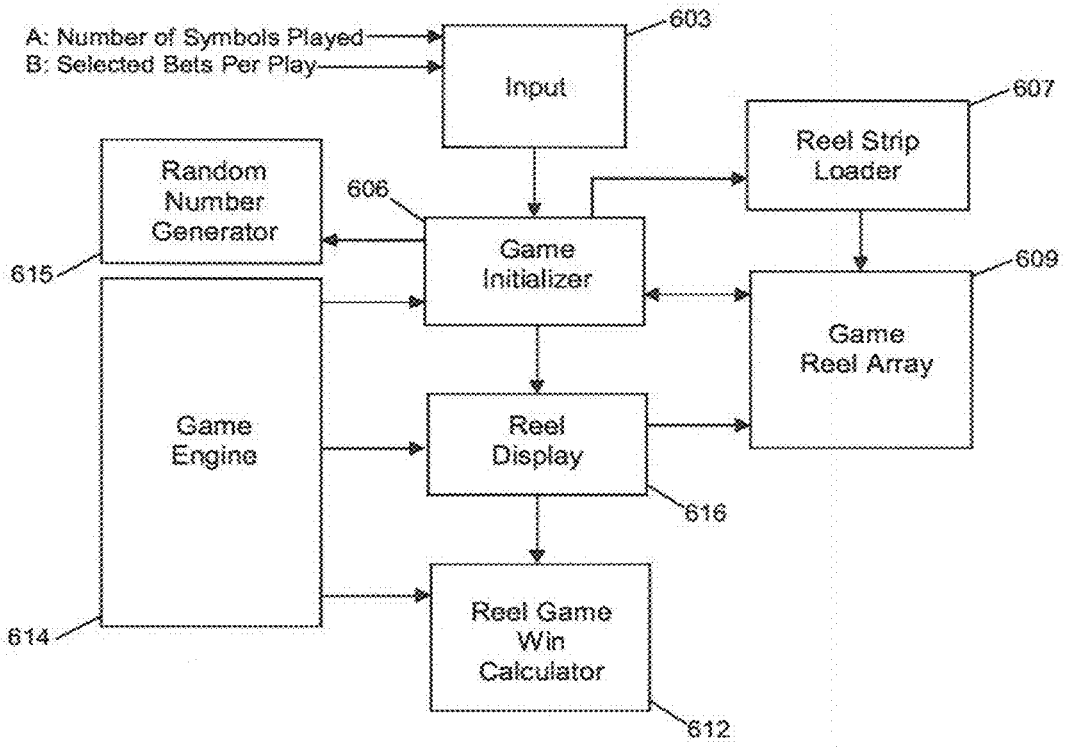
FIG. 6C is a block diagram showing a process structure of a control means.

As shown in FIGS. 6A and 6B, the program starts at 601 in an idle state 602, where in FIG. 6C, an input process 603 waits to receive two principal inputs A and B from the player, namely the number of gold symbols that are to be played A, and the number of credits to be bet per play B. The number of gold symbols corresponds to the particular play option to be selected, where different play options provide for different numbers of gold symbols to be played in a game.

The player then at 604 chooses the particular play option they wish to play, which corresponds to a game designed to include n number of gold symbols. As indicated at 605, this selection determines the prescribed mix of symbols to be used on the reels, corresponding to the play option n chosen. The steps 604 and 605 then invoke a play game state 606A, when both input parameters A and B are selected. In process terms, a game initializer process 606 is activated by the input process 603, which, in turn, invokes a reel strip loader 607 to load the reel symbols corresponding to the particular play option selected from a table of symbol lists 608, stored in memory, into a game reel array 609.

The process is shown at step 610, whereby the particular reel strips of symbols selected will contain the five bonus symbols in either an enhanced (gold) or unenhanced state, depending upon the play option involved and the standard symbols common to all play options.

The process is performed as part of a random stops state 611, which automatically selects the maximum number of paylines that are available for a play, e.g., 25, and the play cost, which is determined by accessing a table of costs (not shown) using the number of enhanced or gold symbols played n as an index. For example:

1 gold symbol played→gold symbol play cost=1
2 gold symbols played→gold symbol play cost=5
3 gold symbols played→gold symbol play cost=15
4 gold symbols played→gold symbol play cost=30
5 gold symbols played→gold symbol play cost=60

The total credits bet calculation in the reel game win calculator process 612 is then set up according to the formula:

Total credits bet=gold symbol play cost×credits bet per play

The credit meter (not shown) is decremented by the total credits bet and the reel strips determined by accessing the table of reel strip lists 608 using the number of gold symbols n again as an index. For example:

1 gold symbol played→reel strips containing 1 gold symbol
2 gold symbols played→reel strips containing 2 gold symbols
3 gold symbols played→reel strips containing 3 gold symbols
4 gold symbols played→reel strips containing 4 gold symbols
5 gold symbols played→reel strips containing 5 gold symbols The game is played at 613 by a game engine process 614 invoking a random number generator 615 to randomly choose reel stops from the particular reel strip selected by the game initializer 606 and display the reel symbols using a reel display process 616.

This involves invoking a spin the reels state 617, where the reel strips of the previous game are spun off the display and the current reel strips are spun onto the display.

A calculate reel game win state 618 is then invoked at step 619 using the reel game win calculator 612. This process involves determining the paylines by using the reels stops within the reel strips and calculating line wins from each line. Scatter wins are also calculated from the reel stops within the reel strips and total wins are sent to the credit meter at 620.

A feature triggered state 621 is invoked to test for the existence of a trigger condition after each play, and if a trigger condition exists, then a play the feature state 622 is invoked. In either case, a credits win state 623 is invoked to test to see if any credits have been won.

Optionally, a gamble state 624 may be invoked, and if the player chooses to gamble on the winnings of the play, a play the gamble state 625 is then invoked.

Ultimately, the state play that has proceeded is stored in a history table by invoking a store in history state 626, and the process ended at 627.

The state flow is then returned to the idle state 602 ready to repeat again for the next play.

From a game design perspective, in the present mode, the reels for each of the play options are designed having regard to a number of key parameters. In terms of priority, these are:

1) The RTP for each play option needs to be within a prescribed range. For example, the variation in RTP across all play options must be no more than 0.2%.
2) The hit rate for each play option needs to be approximately the same, although not necessarily identical, within each play option. For example a non-limiting example of a hit rate is one that would occur approximately every 2 or 3 plays.
3) The distribution and types of wins are determined in order to provide optimum player excitement and entertainment. This is achieved by providing the maximum number of paylines to trigger wins, different bonusing schemes for each of the play options (i.e., the number and mix of standard to bonus symbols appearing on the different reels and between different play options), and varying the number of free games or spins awarded in features between the different game options.

Given these parameters, the game designer is provided with a reasonable amount of scope to design a game that has appeal to a variety of different types of players, and provide excitement and entertainment.

The first specific embodiment of a game designed for carrying out the mode of the invention is described with respect to the table shown in FIG. 7 and uses symbols corresponding to common playing cards with a standard 3×5 matrix with 5 spinning reels.

In this embodiment, the following bonus symbols make up the reels:

[A], [K], [Q], [J], [10]

and the game uses a typical left-to-right payline rule, with prizes awarded according to the paytable shown in Table 7.1.

A traditional set of 25 paylines are used and are fixedly activated automatically for each play.

Significantly, instead of the player selecting the number of lines to play to start the game, one of five play options is selected. These five play options, or betting options, are shown diagrammatically in Table 7.2.

In this setup, each successive bet option "activates" prescribed bonus symbols to their enhanced state. The game then provides increased prizes when the enhanced bonus symbols occur in a win. The increased prizes that apply in the present game are shown in the paytable in Table 7.3.

Thus, when playing the first play option, combinations of [10] will be paid according to the increased pay column in Table 7.3. For the second play option, both [10] and [J] will pay the increased prize, and so on, until the fifth play option is selected, where all combinations of [A], [K], [Q], [J], [10] will pay the increased prizes.

For effect, the bonus symbols would appear on the reels in an enhanced state once activated, but in other embodiments, this need not be the case. In either case, an indicator screen is included (e.g., in the top right-hand corner of the game screen) that indicates to the player which play or bet option is in play. For example, the indicator screen may include check boxes against the bonus symbols, and be illuminated for those bonus symbols that are in an enhanced state, e.g.:

☐ [A] ☐ [K] ■ [Q] ■ [J] ■ [10]

would indicate that the third play option has been selected with the [Q], [J], [10] bonus symbols activated to function in their enhanced state.

In addition, the game will have the same "credit options" as are usual for most other kinds of spinning reel games. However, instead of the concept of "credits bet per line," which applies to a line-selective-based game, the present arrangement would connote a concept of "credits bet per play," where the number of credits bet would be automatically extended across all paylines in operation.

An example of this implementation is shown below:

| 1 credit × play option | 2 credits × play option | 5 credits × play option | 10 credits × play option | 20 credits × play option |
|---|---|---|---|---|

So if, for instance, the 2 credits bet per play option was selected with the fifth play option selected (i.e., costing 60 credits), then this would cost the player 120 credits per play.

The second embodiment of a game designed for carrying out the mode of the invention is illustrated in FIGS. 8 to 12.

In this embodiment, a Chinese theme is adopted. The program for this game follows the same format as shown in FIGS. 6A through 6C and adopts the same concepts as described for the game in the first embodiment.

Figure 9:
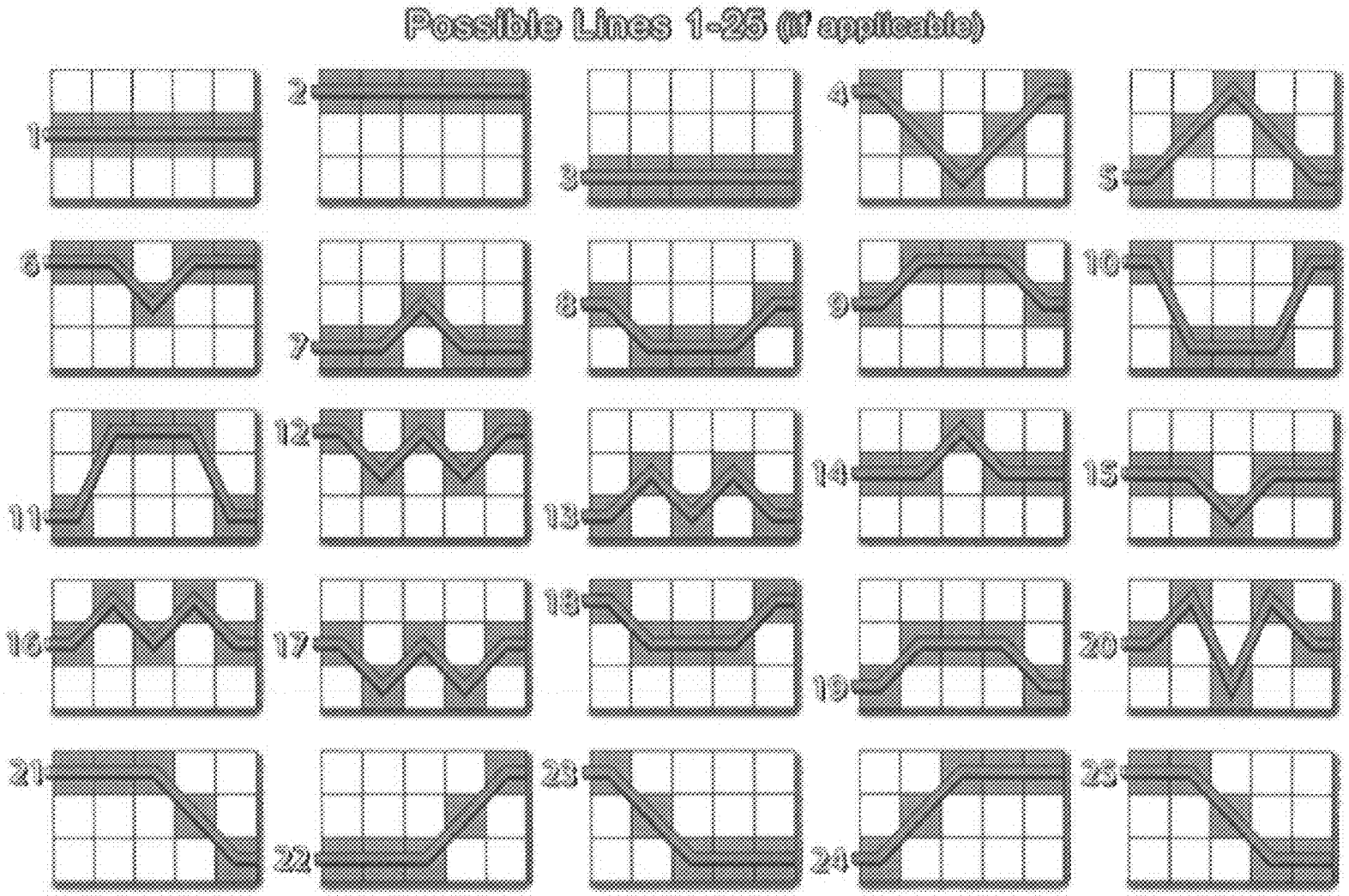
FIG. 9 shows paylines that are applied in the game of the second embodiment.

The specific game rules are shown in FIG. 8 and the paylines that are fixed for each play are shown in FIG. 9.

Figure 10:
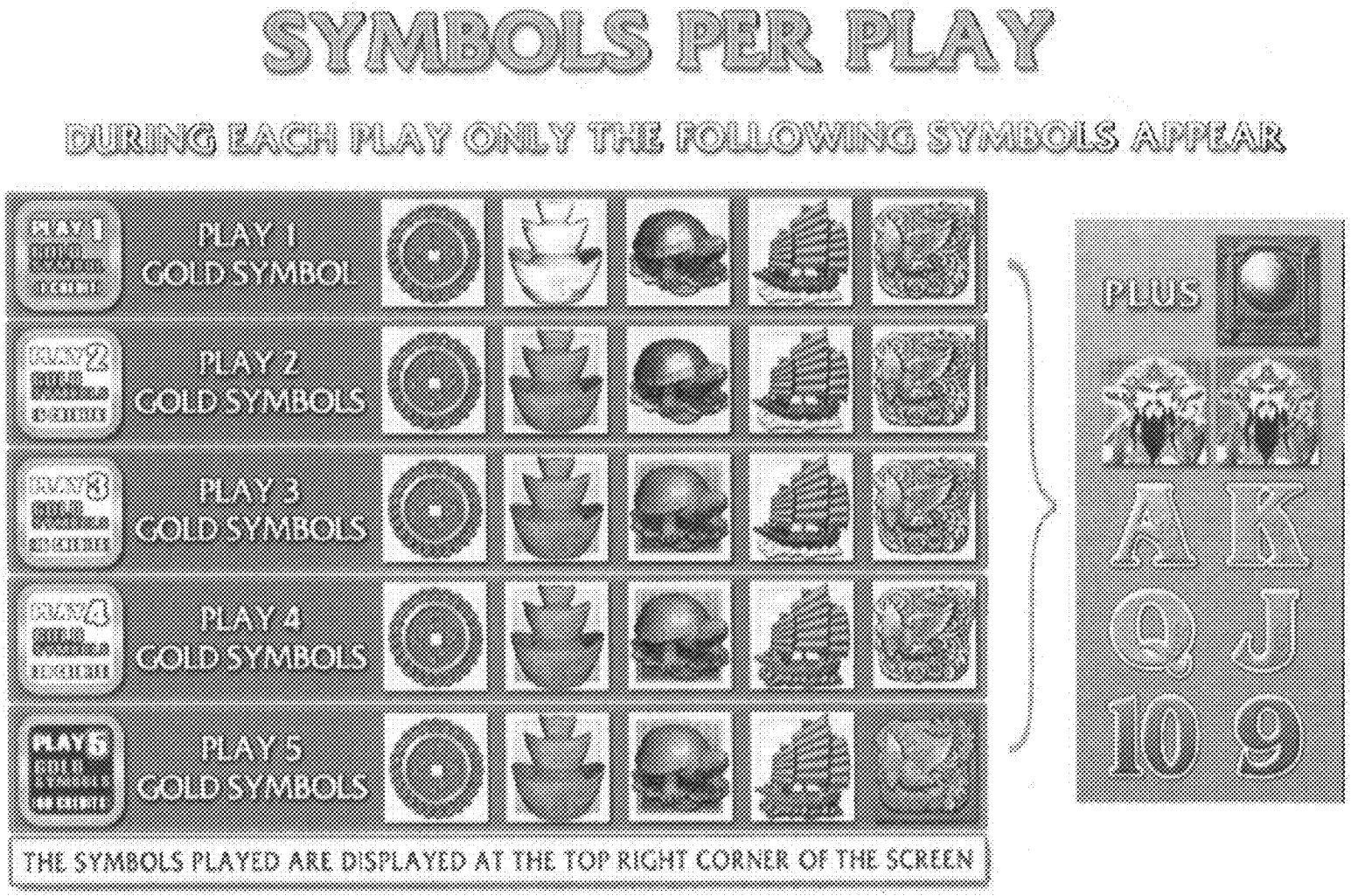
FIG. 10 shows standard and bonus symbols that are used in the game of the second embodiment.
Figure 11:
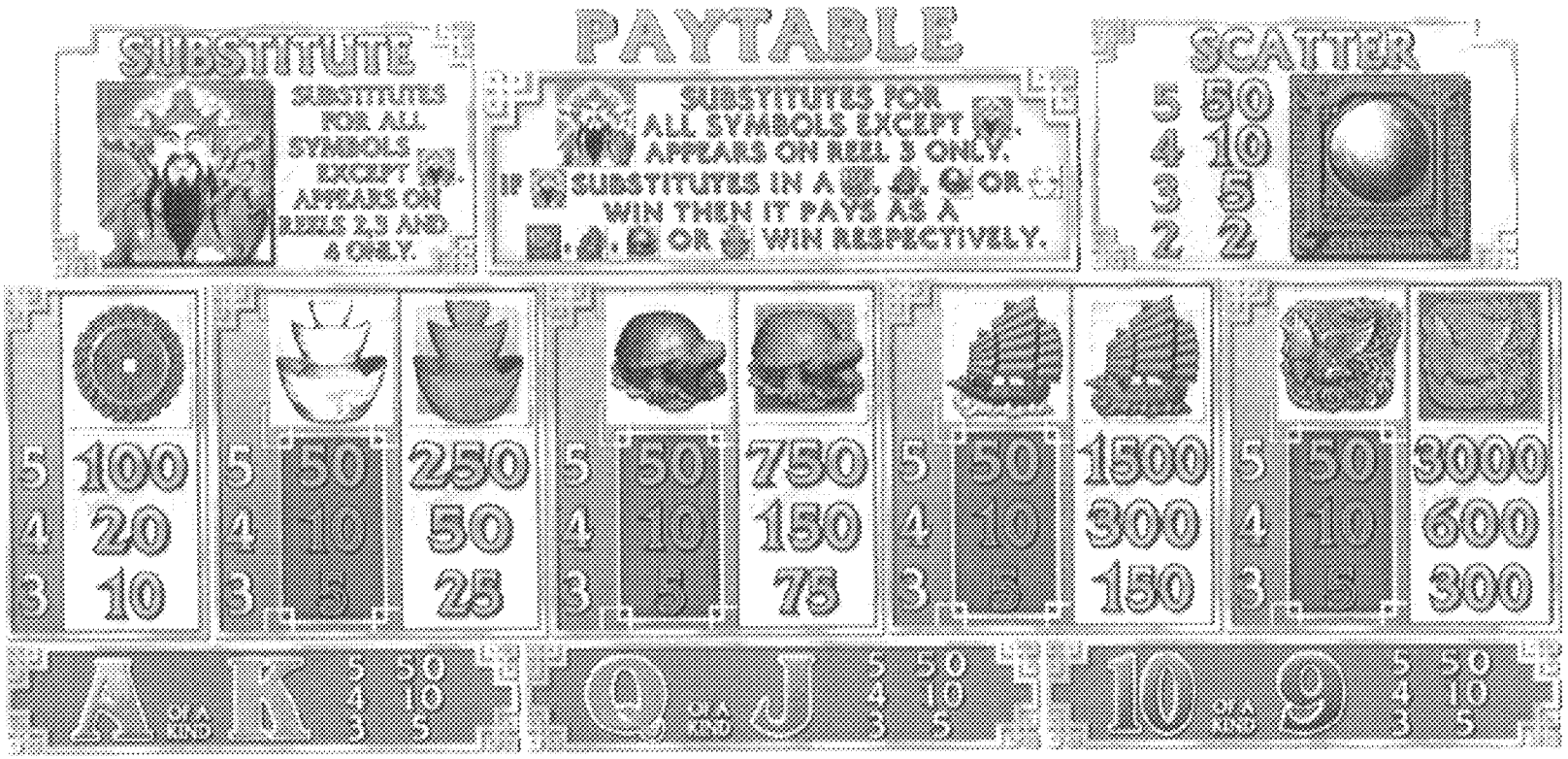
FIG. 11 shows a paytable applicable for each play option corresponding to the bonus symbols available for play in the game of the second embodiment.

As shown in FIGS. 10 and 11, the symbols comprise: five Chinese icons as the bonus symbols, the qualifier "gold" as the enhancement of these symbols, and the top six playing cards as standard symbols in addition to the bonus symbols. In addition, a special bonus symbol is included to function as a substitute symbol, which is also able to be enhanced, and a scatter symbol is provided.

Scatters and substitutes are common gaming machine concepts for bonusing, and add to the character and appeal of the game.

In the present embodiment, as shown in the paytable in FIG. 11, the special bonus symbol in a base state appears only on reels 2, 3 and 4, and, in its enhanced state, appears only on reel 3. Significantly, as a consequence of providing enhanced bonus symbols, when the substitute special bonus symbol appears in its enhanced state with a prescribed combination of bonus symbols in their base state on a payline, the prize amount will be elevated by the program to the equivalent of that applying to the bonus symbols, as if they were in their enhanced state.

FIG. 12 shows the rules applying to the provision of free games, which are triggered by a prescribed number of scatter symbols appearing in the matrix and which are graded in magnitude according to the number of enhanced bonus symbols in play. As previously described, the number of enhanced bonus symbols corresponds to the particular play option selected.

The third embodiment of a game designed for carrying out the mode of the invention is illustrated in FIGS. 13 to 20.

Figure 14:
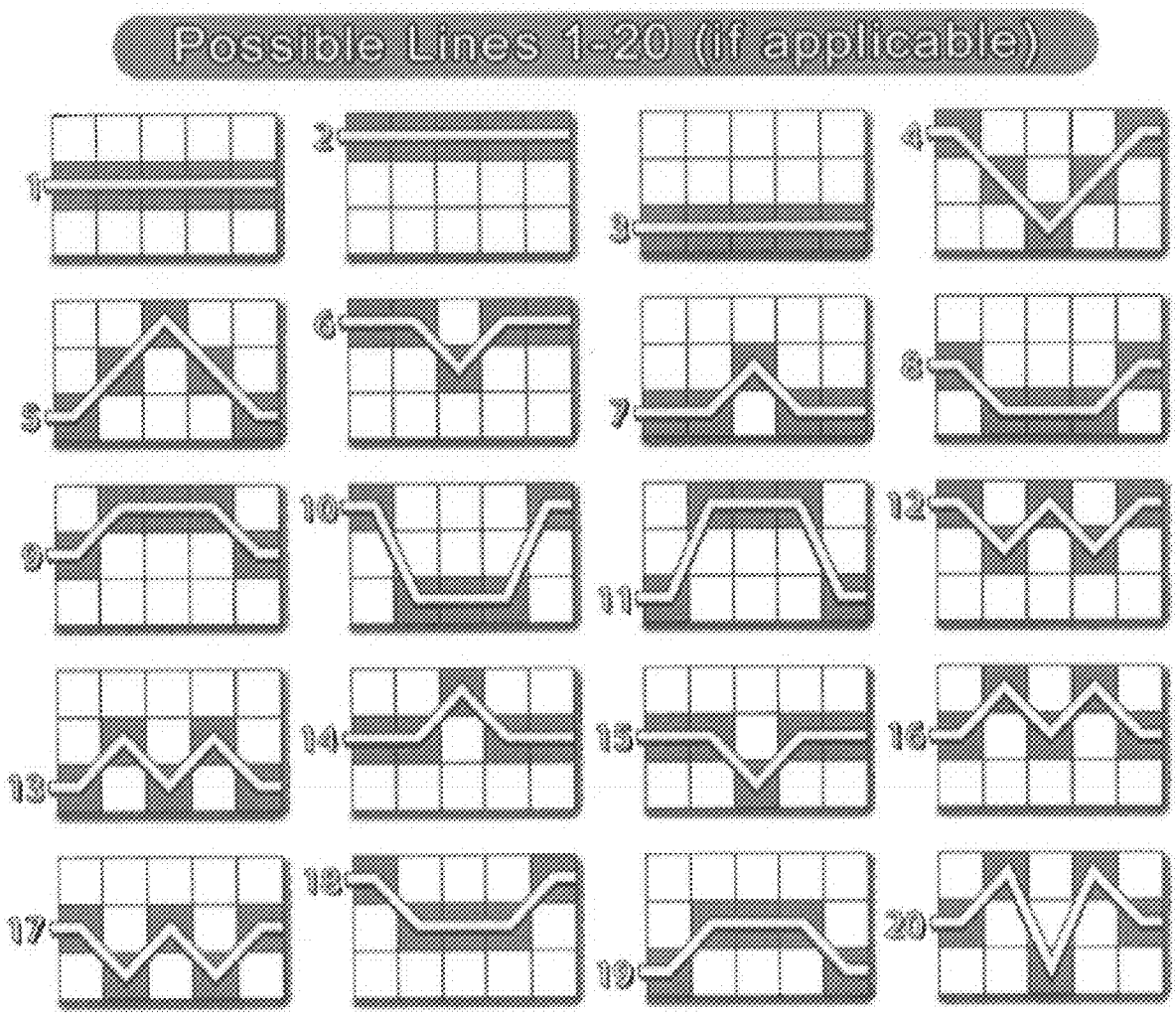
FIG. 14 shows paylines that are applied in the game of the third embodiment.

This game, for all intents and purposes, is substantially similar to that described in the preceding embodiment, except that it: has an "Australiana" theme, reduces the number of paylines to 20 as shown in FIG. 14, consolidates the function of the special bonus symbol with that of a bonus symbol, and provides for a feature or jackpot award in response to a particular bonus triggering system.

Figure 15:
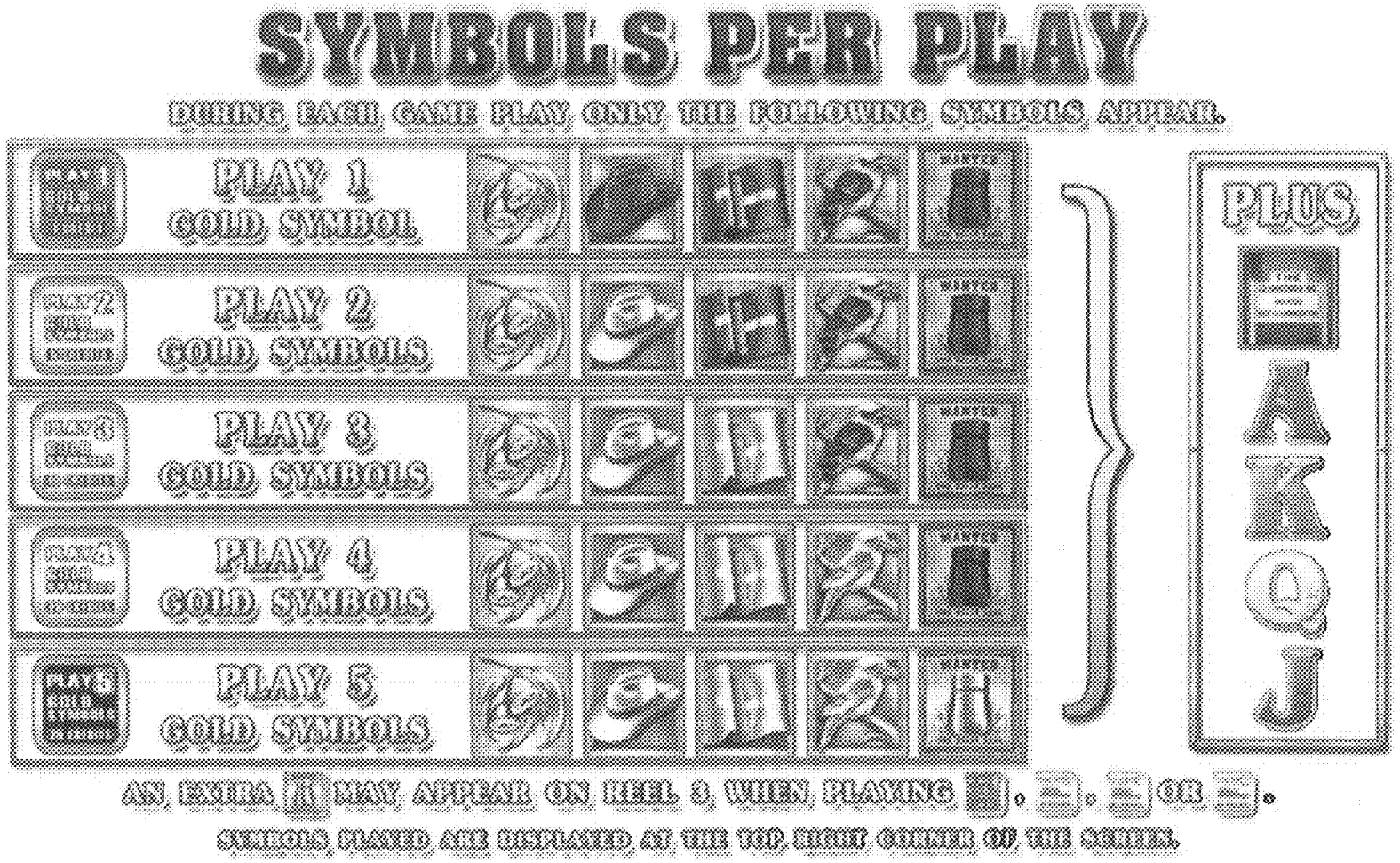
FIG. 15 shows standard and bonus symbols that are used in the game of the third embodiment.
Figure 16:
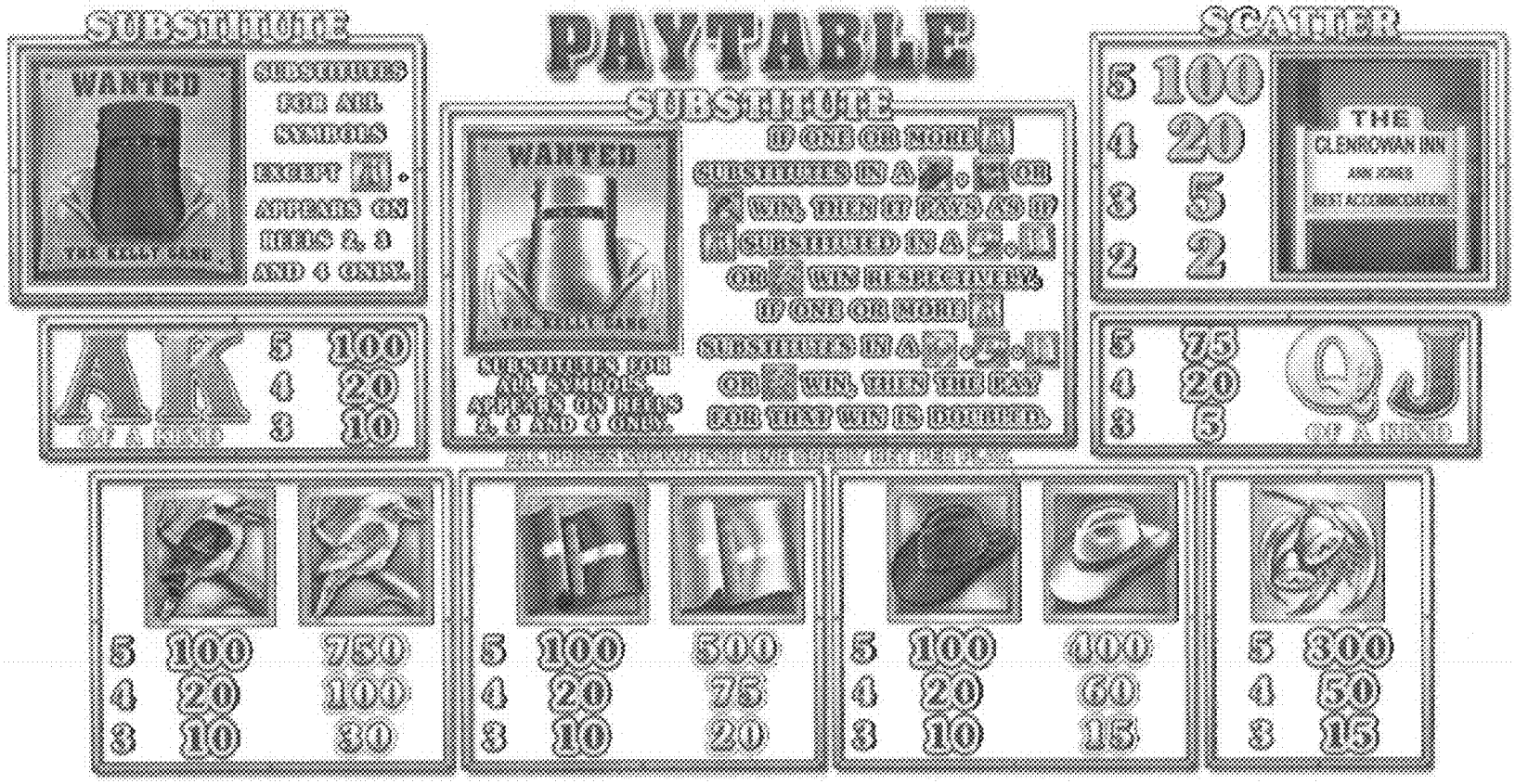
FIG. 16 shows a paytable applicable for each play option corresponding to bonus symbols available for play in the game of the third embodiment.

As shown in FIGS. 13, 15 and 16, the substitute special bonus symbol functions also as the highest valued bonus symbol, thereby serving a dual function, and can operate in a base state and in an enhanced state. Further, when operating in an enhanced state, it doubles the prize amount when substituting for an enhanced symbol of a lesser value.

Figure 17:
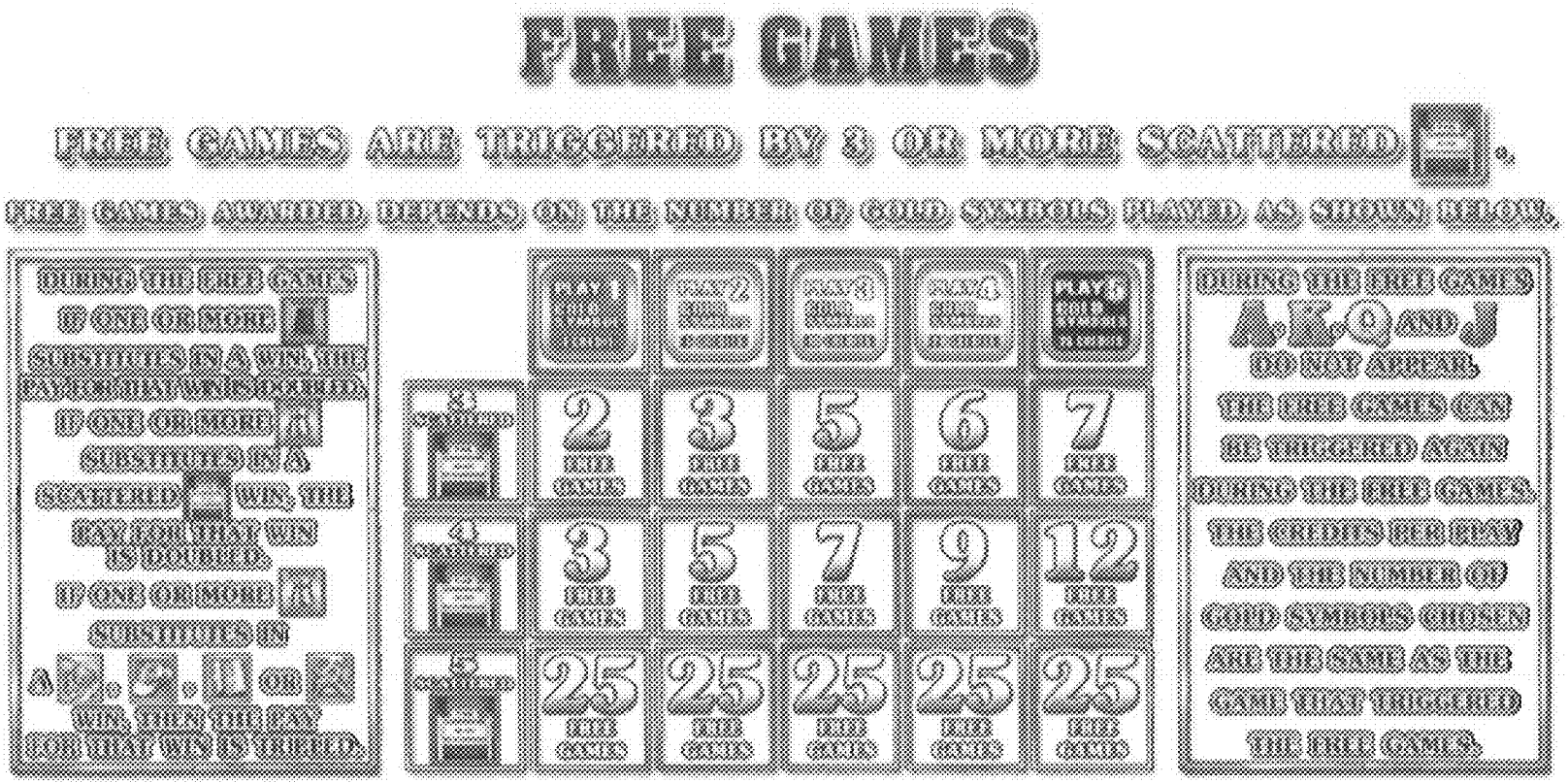
FIG. 17 shows free games rules that are applied in the game of the third embodiment.

The rules for free games provided by the scatter symbol are shown in FIG. 17, along with the paytable, which provides for additional free games with additional scatters beyond the three.

Figure 18A:
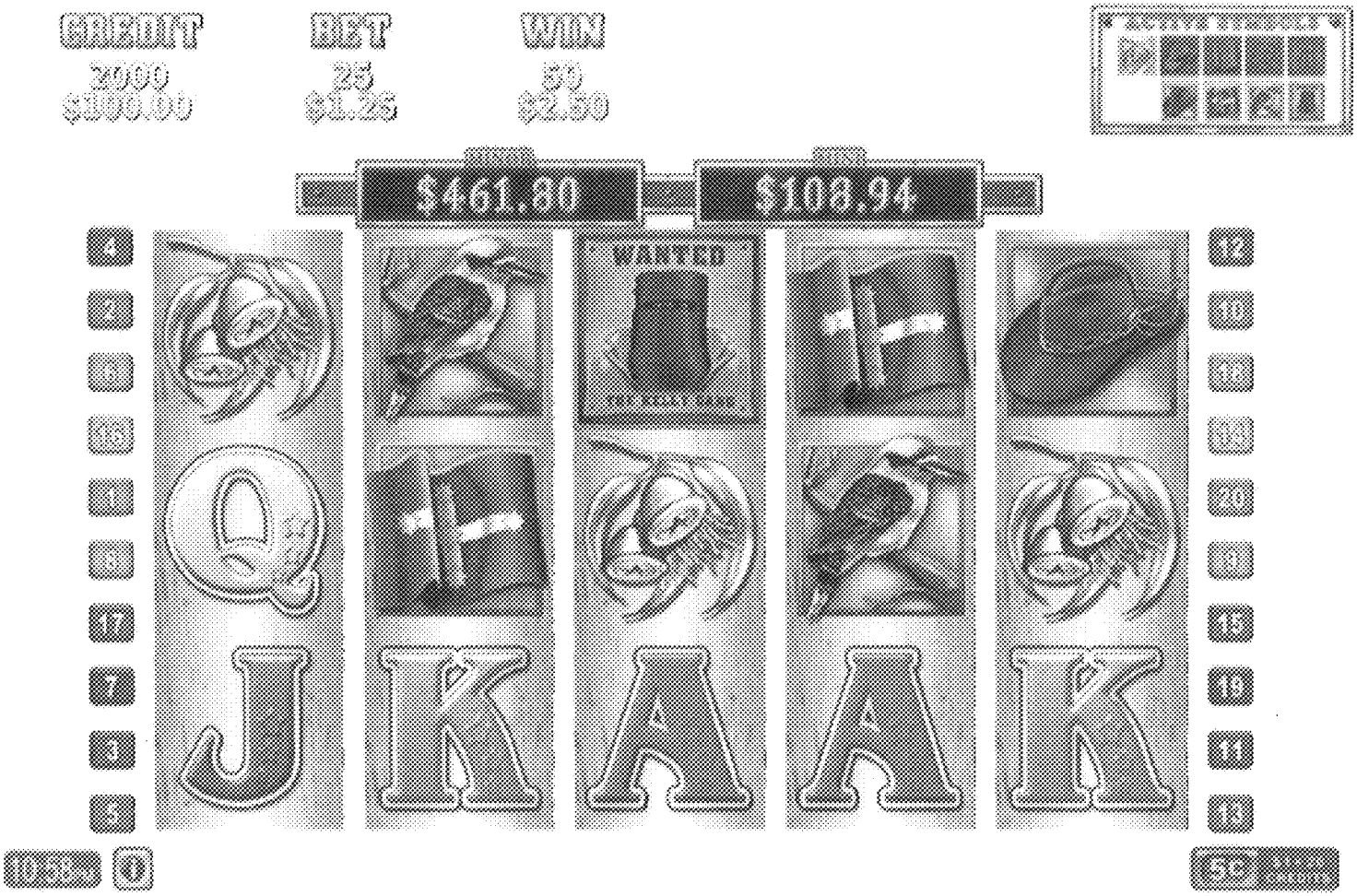
Figure 18B:
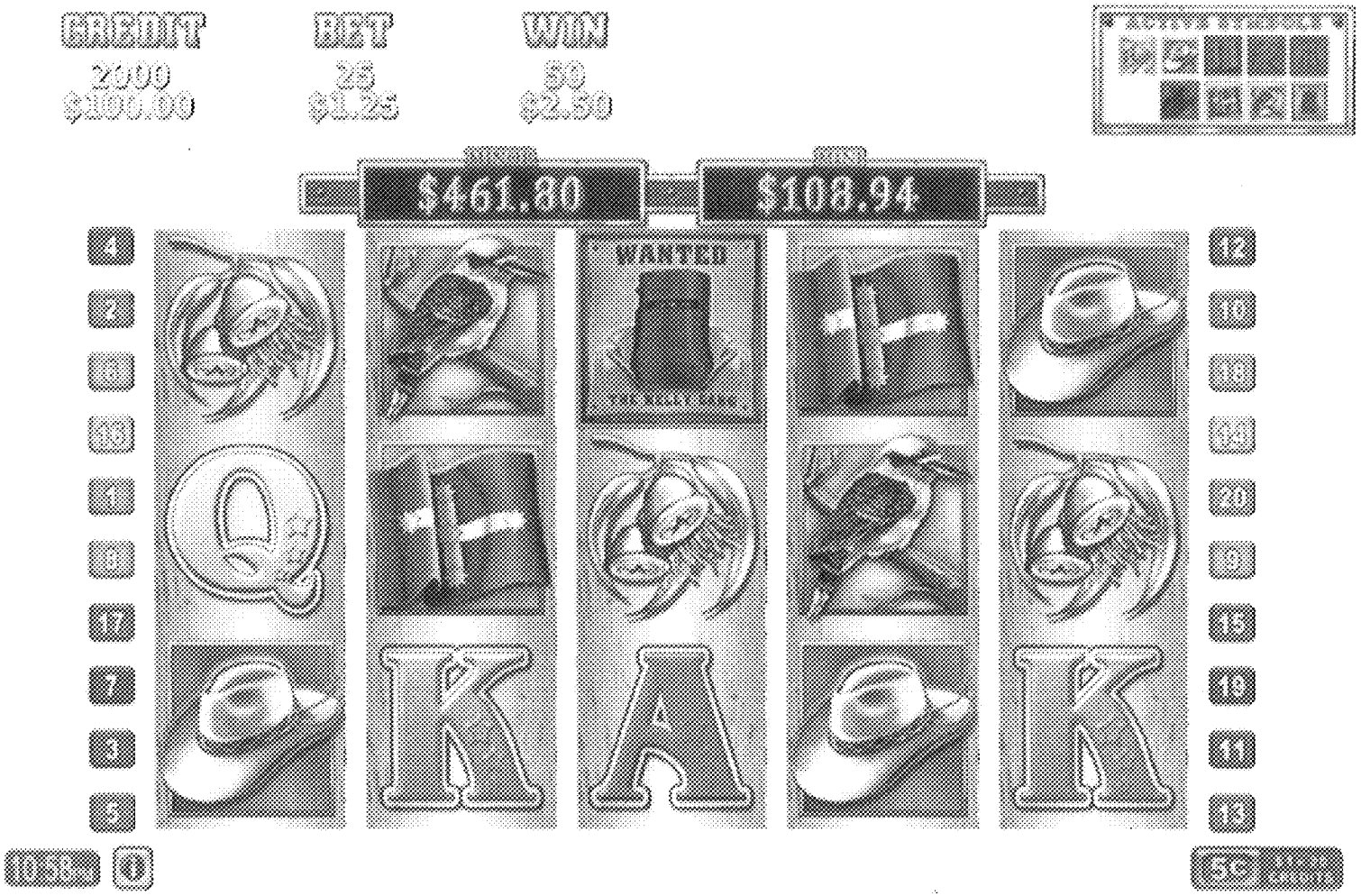

FIGS. 18A through 18C show the effect of changing play options on bonus symbols appearing in the play window and in the activation box.

In FIG. 18A, the first play option is selected, which is the equivalent of selecting a single enhanced bonus symbol for play. In the present embodiment, an enhanced bonus symbol is termed a "gold symbol," and in the first play option corresponds to the "gold gumleaf." As shown in the activation box in the top right-hand corner, the top row depicts the bonus symbols that can be enhanced and highlights those that have been activated to their enhanced state. The bottom row depicts those bonus symbols that can be in a base state and highlights those that are in an enhanced state. As in the preceding embodiment, the lowest valued gold symbol is the "gold gumleaf" and this will be in a permanently enhanced state. Hence, it does not have a symbol appearing in the bottom row. In the window, all bonus symbols appear in their base state, apart from the "gold gumleaf," which is always in its enhanced state.

In FIG. 18B, the second play option is selected, which is the equivalent of selecting two "gold symbols" for play. In this case, the next highest valued bonus symbol is the "hat," and so this appears enhanced as a "gold hat" in both the activation box and the window. It should be noted that the state of a bonus symbol is alternate, i.e., it can either be in an enhanced state or a base state, depending upon the particular play option selected, but it cannot be both.

In FIG. 18C, the fifth play option is selected, which is the equivalent of selecting all five "gold symbols" for play. In this case, all "gold symbols," comprising the "gold gumleaf," the "gold hat," the "gold flag," the "gold kookaburra" and the "gold Ned," are activated, as shown in the activation box. This play option provides the maximum number of opportunities for the player to win, invoking the highest level of the paytables.

Figure 20:
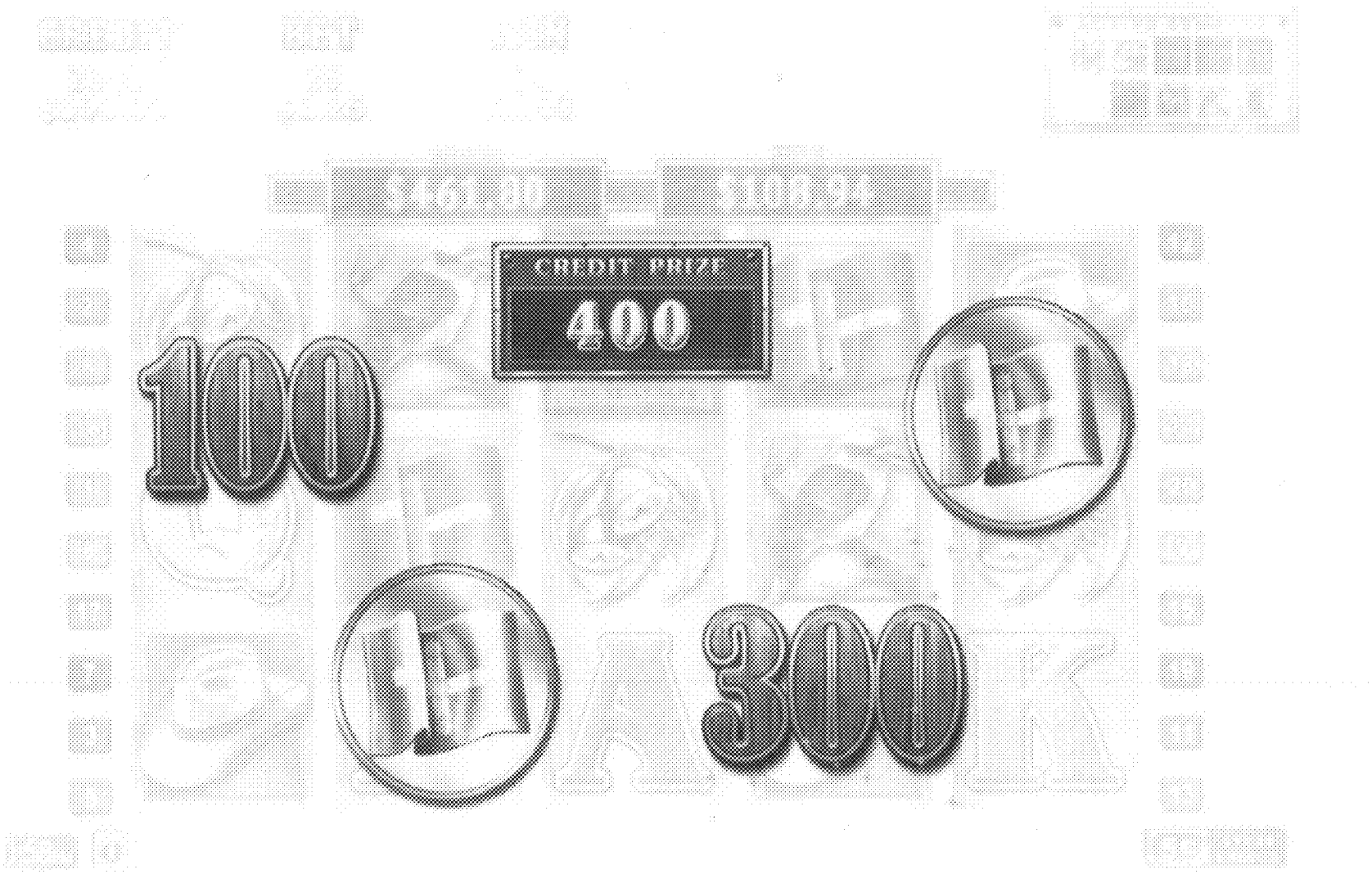
FIG. 20 shows the window displaying an outcome of the feature and jackpot award system on triggering and playing, with the game of the third embodiment.

Significantly, as shown in FIGS. 13, 15 and 16, and referred to in FIGS. 19 and 20, the game has a bonus feature or jackpot award that is separately triggered from the rules that apply to the base game. In the present embodiment, the jackpot award is fixed. However, in other embodiments, the jackpot may be a progressive jackpot and be accumulated from the gaming machine in either a standalone arrangement, or, alternatively, be part of a pool where the gaming machine is linked into a network with other gaming machines that all contribute to the jackpot pool.

The rules defining the operation of the triggering system for the bonus feature or jackpot award are shown in FIG. 19, and are based on the independent and random operation of a pair of bonus trigger symbols that are confined to appearing in Reels 1 and 2.

As indicated in the rules, and consistent with the operation of the substitute special bonus symbol, which also functions as the highest valued bonus symbol, this symbol does not appear on Reel 1, and so does not interact with the bonus trigger symbol operating on this reel. However, it is included on Reel 2, and so does interact with the bonus trigger symbol operating on that reel.

The bonus trigger symbols only become active when they appear on an enhanced bonus symbol. Further, they only trigger the bonus feature or jackpot award when they are active and appear together on a payline.

Once triggered, a second screen feature/jackpot mode is invoked, which, in the present embodiment, suspends the base game and enters a feature/jackpot phase or game. In the feature/jackpot phase of the present embodiment, a plurality of even-numbered award symbols appear presented in the form of gold coins. Half of the bonus awards depict one of the activated enhanced bonus symbols that triggered the bonus on one of the reels, and the other half of the bonus awards depict the other activated enhanced bonus symbol on the other reel that triggered the bonus.

Each bonus award is randomly linked to either a credit prize or a jackpot award, providing an even chance of either being awarded. The credit prizes are scaled in accordance with the paytable to different ranges of credit prizes, which correspond to the graded value of the enhanced bonus symbol, one of the prizes in the range being randomly selected as the prize.

As indicated, the lowest valued enhanced bonus symbol (i.e., the "gold gumleaf") provides the lowest range of credits (25 and 50 credits);

the next highest valued enhanced bonus symbol (i.e., the "gold hat") includes a higher credit prize in its range (25, 50 and 100 credits);

the next highest valued enhanced bonus symbol (i.e., the "gold flag") provides a higher range again (50, 100 and 200 credits);

the next highest valued enhanced bonus symbol (i.e., the "gold kookaburra") provides a higher range again (100, 200 and 300 credits); and the highest valued enhanced bonus symbol (i.e., the "gold Ned") provides the highest range (200, 300 and 500 credits).

The jackpot award provides for a plurality of jackpot prizes as shown on the topbox display in FIG. 13. In the present embodiment, there are four jackpot awards, scaled down in value from the top jackpot prize, the "Gold Jackpot," to the "Major Jackpot," then the "Minor Jackpot," and lastly, the "Mini Jackpot."

Triggered bonus awards are accumulated for every triggering event occurring on a payline, and will sequence through discrete feature/jackpot phases until all triggered bonuses are awarded.

FIG. 20 shows a partially completed feature/jackpot phase, where the first two bonus awards have revealed awards, in this case being a 100-credit and a 300-credit prize. As shown, a totaling box showing the accumulated value of the credit prizes is displayed in the center of the display.

The two remaining bonus awards, being two "gold flags," are yet to reveal their awards, which, in both cases, will be either a credit prize from the range of 50, 100 or 200 credits, or a jackpot award.

The fourth embodiment is substantially the same as the preceding embodiment, except that the paytable adopted provides the same value for each of the bonus symbols, rather than an incrementing value.

In this manner, the game is simplified and can be designed so that the jackpot feature can be made to scale linearly, helping to meet compliance requirements in particular jurisdictions where linearity is a regulated requirement.

Furthermore, in this embodiment, the game is configured to have a scatter-type jackpot feature triggerable in either a base game or in a free spin game. In the case of the base game, a mini jackpot can be awarded in response to any of the same type of bonus symbol appearing, for example, 8 to 9 times in a 3×5 matrix window, or a minor jackpot in response to the same type of bonus symbol appearing, for example, 10 to 14 times. In the case of a free spin feature being triggered, a major jackpot can be awarded in response to any of the same type of bonus symbol appearing, for example, 8 to 9 times, or a grand jackpot in response to the same type of bonus symbol appearing, for example, 10 to 14 times. In either case, an ultimate jackpot can be awarded in response to the same type of bonus symbol appearing the maximum number of 15 times.

The mode for carrying out the invention has several advantages. Significantly, the player is effectively offered the choice of different levels of volatility with each play option chosen. These play options are on offer on a play-by-play basis following a common game theme and style, but with different paytables operating according to the play option chosen. This is a significant difference from the common types of gaming machines now in vogue, where a single paytable is provided across the entire game.

Furthermore, the player gets the value of playing with all paylines active on every play. Accordingly, a conservative player can achieve the satisfaction of playing with all paylines operating while wagering at the lowest play option.

On the other hand, more volatile players will be attracted to the highest play option to achieve the best perceived value from a play.

It should be appreciated, however, regardless of the perception, the game designer can modify the mathematics with bonus symbol placement and frequency on the reels arbitrarily, but, in doing so, ensure that the overall return to player requirement remains fixed. Consequently, great flexibility to the game designer is provided to ensure maximum enjoyment from the game, while ensuring compliance with the game regulators at all times.

While particular embodiments of this invention have been described, it will be evident to those skilled in the art that the present invention may be embodied in other specific forms without departing from the essential characteristics thereof. The present embodiments and examples are, therefore, to be considered in all respects as illustrative and not restrictive, and all modifications that would be obvious to those skilled in the art are, therefore, intended to be embraced therein.

It will be understood that the invention disclosed and defined herein extends to all alternative combinations of two or more of the individual features mentioned or evident from the text. All of these different combinations constitute various alternative aspects of the invention.

The invention claimed is:

1. A gaming machine for playing a casino wagering game, comprising:

a display screen;

at least one input device;

a non-transitory data storage device storing data corresponding to symbols from which images of the symbols may be selected for display in positions in a displayed array; and a game controller operably coupled with the display screen, the at least one input device, and the data storage device, and configured to:

detect, via the at least one input device, a physical item associated with a monetary value to establish a credit balance;

initiate the casino wagering game in response to an input indicative of a wager covered by the credit balance;

randomly select and display symbols at the display screen to define winning and losing outcomes based on a symbol arrangement in the array during a play of the casino wagering game, wherein a subset of symbols is available during the play of the casino wagering game in one of a base state and an enhanced state responsive to a player selecting from one of a plurality of different play options comprising at least three different play options, each play option of the plurality of different play options defining which symbols of the subset of symbols are in their enhanced state for the play of the casino wagering game, each play option of the plurality of different play options being associated with a different wager selection covered by the credit balance, wherein a number of paylines available to generate the winning and losing outcomes is fixed across all possible play options selectable by the player that use symbols having an enhanced state;

issue an award for a winning outcome having a first value when a symbol used in the winning outcome is in its base state;

issue an award for a winning outcome having a second value when the symbol used in the winning outcome is in its enhanced state, the second value being greater than the first value; and receive, via the at least one input device, a cashout input to initiate a payout from the credit balance.

2. The gaming machine of claim 1, wherein a same paytable is used for all of the play options.

3. The gaming machine of claim 1, wherein a fixed number of paylines corresponds to a maximum number of paylines operable with the gaming machine.

4. The gaming machine of claim 2, wherein each play option uses symbols that contribute to a common theme or style of game played at the gaming machine and displayed by the display element, wherein the symbols of the subset of symbols differ in a color feature during different play options depending on whether or not the respective symbol is in its base state or its enhanced state.

5. The gaming machine of claim 2, wherein a control apparatus provides play options that increment a number of the symbols from the subset of symbols that are available during the play of the game in their enhanced state.

6. The gaming machine of claim 5, wherein the play options increment in number of the symbols from the subset of symbols that are available during the play of the casino wagering game in their enhanced state win an increase of a buy wager amount associated with selection of the selected play option.

7. The gaming machine of claim 6, wherein a total wager amount wagered for the play of the casino wagering game is the product of buy wager amount associated with selection of the selected play option and a selected game wager amount per play.

8. A method for playing a casino wagering game, the method including:

detecting, via at least one input device operatively connected to a game controller, a physical item associated with a monetary value to establish a credit balance;

initiating the casino wagering game in response to an input indicative of a wager covered by the credit balance;

selecting and displaying symbols in a symbol arrangement from a non-transitory data storage device operatively connected to the game controller on a display screen operatively connected to the game controller during a play of the casino wagering game to define winning and losing outcomes, the symbols including a subset of symbols that are available for selection in one of a base state or an enhanced state;

enabling a player to select from a plurality of different play options comprising at least three different play options utilizing the at least one input device prior to the play of the casino waging game, each play option defining which symbols of the subset of symbols are in its enhanced state for the play, each play option of the plurality of different play options being associated with a different wager selection covered by the credit balance, wherein a number of paylines available to generate the winning and losing outcomes is fixed across all possible play options selectable by the player that use symbols having an enhanced state;

issuing an enhanced award value for a winning outcome that includes a symbol in its enhanced state in comparison to a lesser award value for a winning outcome with the symbol in its base state; and receiving, via the at least one input device, a cashout input to initiate a payout from the credit balance.

9. The method of claim 8, wherein selecting and displaying symbols in a symbol arrangement are according to a fixed number of symbol arrangements.

10. The method of claim 8, wherein the number of paylines is a maximum number of paylines for the casino wagering game.

11. The method of claim 8, wherein each play option defining which symbols of the subset of symbols are in its enhanced state for the play has an increasing number of symbols from the subset of symbols that are available for selection in its enhanced state responsive to increasing a buy wager amount corresponding with the selection of the play option.

12. An electronic video gaming machine for playing a casino wagering game, comprising:

a video display screen;

at least one player interface; and a game control processor operably coupled with the video display screen and the at least one player interface, the game control processor configured to:

detect, via the at least one player interface, a physical item associated with a monetary value to establish a credit balance;

initiate the casino wagering game in response to an input indicative of a wager covered by the credit balance;

control images of game symbols to be displayed at positions of a display matrix on the video display screen during a play of the casino wagering game to define winning and losing outcomes;

randomly select, for each play of the casino wagering game, the game symbols for display, the game symbols being randomly selected from a subset of game symbols available for selection in either a base state or an enhanced state depending on a play option selected for the play of the casino wagering game from a plurality of play options comprising at least three different play options, each play option of the plurality of different play options being associated with a different wager selection covered by the credit balance, wherein a number of paylines available to generate the winning and losing outcomes is fixed across all possible play options selectable by the player that use symbols having an enhanced state;

determine a prize based on a pay table that is common across all play options, wherein the prize for a winning outcome is greater when a symbol used in the winning outcome is in its enhanced state as compared to when the symbol used in the winning combination is in its base state; and receive, via the at least one player interface, a cashout input to initiate a payout from the credit balance.

13. The electronic video gaming machine of claim 12, wherein the game control processor provides play options having a different number of the symbols from the subset of symbols that are available during the play of the casino wagering game in their enhanced state.

14. The electronic video gaming machine of claim 12, wherein the game control processor is further configured to determine winning outcomes based on the fixed number of paylines for each play.

15. The electronic video gaming machine of claim 14, wherein each play option uses symbols that contribute to a common theme or style of game played under the gaming machine and displayed by the video display, despite changes in bonusing scheme and pay arrangements that are available to be adopted between play options.

16. The electronic video gaming machine of claim 14, wherein the fixed number of paylines corresponds to a maximum number of paylines operable with the gaming machine.

17. The electronic video gaming machine of claim 12, wherein the player interface configured to receive a buy wager amount of $W_1$ to select a player option that defines symbol $N_1$ to its enhanced state, and a buy wager amount of $W_2$ to select a player option that defines symbols $N_1$ and $N_2$ in their respective enhanced states.

18. The electronic video gaming machine of claim 12, wherein the game symbols include game specific standard symbols and bonus symbols.

19. The electronic video gaming machine of claim 18, wherein the bonus symbols are the subset of game symbols available for selection in either the base state or the enhanced state depending on the selected play option from a plurality of play options.

* * * * *